US009689220B2

(12) United States Patent
MacLeod et al.

(10) Patent No.: US 9,689,220 B2
(45) Date of Patent: Jun. 27, 2017

(54) DOWNHOLE APPARATUS

(71) Applicant: ISLE TOOLS LIMITED, Aberdeen (GB)

(72) Inventors: Iain Morrison MacLeod, Newmacher (GB); Andrew Fraser, Inverurie (GB); Andrew John Elrick, Peterhead (GB)

(73) Assignee: Isle Tools Limited, Aberdeen (GB)

( * ) Notice: Subject to any disclaimer, the term of this patent is extended or adjusted under 35 U.S.C. 154(b) by 11 days.

(21) Appl. No.: 14/783,219

(22) PCT Filed: Apr. 9, 2014

(86) PCT No.: PCT/GB2014/051112

§ 371 (c)(1),
(2) Date: Oct. 8, 2015

(87) PCT Pub. No.: WO2014/170640

PCT Pub. Date: Oct. 23, 2014

(65) Prior Publication Data

US 2016/0047189 A1 Feb. 18, 2016

(30) Foreign Application Priority Data

Apr. 15, 2013 (GB) ..... 1306838.2

(51) Int. Cl.
*E21B 23/04* (2006.01)
*E21B 23/06* (2006.01)
*E21B 41/00* (2006.01)

(52) U.S. Cl.
CPC ..... *E21B 23/04* (2013.01); *E21B 23/06* (2013.01); *E21B 41/00* (2013.01)

(58) Field of Classification Search
CPC ..... E21B 23/04; E21B 23/06; E21B 41/00
See application file for complete search history.

(56) References Cited

U.S. PATENT DOCUMENTS 3,177,938 A * 4/1965 Roussin ..... E21B 17/1021 166/104
6,173,786 B1 1/2001 Sampson et al.
2011/0259607 A1* 10/2011 Carisella ..... E21B 23/04 166/381

FOREIGN PATENT DOCUMENTS

WO 2012150189 A2 11/2012

OTHER PUBLICATIONS

International Search Report & Written Opinion (PCT/GB2014/051112), dated Sep. 30, 2014.

* cited by examiner

*Primary Examiner* — James G Sayre
(74) *Attorney, Agent, or Firm* — Gregory L. Porter; Andrews Kurth Kenyon LLP

(57) ABSTRACT

A setting tool (10) for use in a downhole wellbore is described as having a hydraulic fluid pumping mechanism (78) for providing pressurized hydraulic fluid. A piston mechanism (116) is moveable by said pressurized hydraulic fluid acting upon a portion of the piston mechanism (116). A resetting mechanism (84) is provided which when operated releases the pressurized hydraulic fluid from acting upon said portion of the piston (116) and which results in the resetting of the setting tool (10). In addition, a method for resetting a setting tool (10) is described including the steps of:

(i) running the setting tool (10) downhole;
(ii) actuating the setting tool (10) and thereby deploying an apparatus (203) downhole;
(iii) retrieving the setting tool (10) to surface; and
(iv) bleeding off pressure to reset the setting tool (10).

31 Claims, 23 Drawing Sheets

DOWNHOLE APPARATUS

TECHNICAL FIELD

The present invention relates to a downhole apparatus for setting a tool. More particularly, but not exclusively, the present invention relates to a setting tool and a method for repeated use and maintenance of same.

BACKGROUND

Apparatus such as plugs, packers and hangars are commonly deployed in downhole oil and gas wellbores. The apparatus is typically run downhole and a setting force is applied to expand the outer diameter of the apparatus such that the apparatus contacts the interior of the wellbore. Setting force can be applied using a setting tool that is run downhole connected to the tool to be set in the wellbore. Electronics embedded within the setting tool typically activate the setting tool to set the apparatus after a certain predetermined period of time. The time period is predetermined to account for the time taken to run the apparatus to the required downhole depth with some additional redundancy in case of unforeseen delays. Once the predetermined time period has elapsed the electronics triggers actuation of a setting mechanism to deploy the apparatus and expand the outer diameter.

Following the setting of the apparatus downhole, the setting tool is released from the apparatus and retrieved to surface. At surface the tool is typically stripped down by a skilled operator. The electronics embedded within the setting tool can then be accessed and reprogrammed for use with another apparatus. Rewiring, soldering and/or replacement of failed electronic components is undertaken by a skilled technician as required. The tool is stripped down so that seals, batteries and other consumable components can be replaced before the next use of the tool. Thus, typical setting tools suffer from the disadvantage that the presence of a skilled technician is a prerequisite for strip down and reprogramming of the setting tool prior to its redeployment in the wellbore.

SUMMARY

According to one aspect of the invention, there is provided a method for resetting a setting tool including the steps of:

(i) running the setting tool downhole;

(ii) actuating the setting tool and thereby deploying an apparatus downhole;

(iii) retrieving the setting tool to surface; and (iv) bleeding off pressure to reset the setting tool.

Preferably, the method further comprises the step of:

(v) repeating steps (i) to (iv)

thereby providing a method for multiple use of the setting tool.

According to one aspect of the invention, there is provided a method for multiple use of a setting tool including the steps of:

(i) running the setting tool downhole;

(ii) actuating the setting tool and thereby deploying an apparatus downhole;

(iii) retrieving the setting tool to surface;

(iv) bleeding off pressure to reset the setting tool; and (v) repeating steps (i) to (iv).

Following step (iii), the method can further include the step of remotely accessing data from the setting tool.

According to another aspect of the invention there is provided a setting tool for use in a downhole wellbore, the setting tool comprising:

a hydraulic fluid pumping mechanism for providing pressurised hydraulic fluid;

a piston mechanism moveable by said pressurised hydraulic fluid acting upon a portion of the piston mechanism;

and a resetting mechanism which when operated releases the pressurised hydraulic fluid from acting upon said portion of the piston and which results in the resetting of the setting tool.

Preferably, the setting tool is operable to provide mechanical movement to set a downhole apparatus such as a packer or the like when required. Preferably, movement of the piston mechanism provides the mechanical movement to set the said downhole apparatus when required.

Typically, the piston mechanism is located within a cylinder arrangement and which is further typically located within a housing of the setting tool.

Preferably, movement of the piston mechanism in a first direction provides the mechanical movement to set the said downhole apparatus when required. More preferably, movement of the piston mechanism in a second direction results in the resetting of the setting tool when required.

Preferably, the setting tool further comprises a biasing device adapted to store energy and which more preferably stores energy when said piston mechanism moves in a first direction and which is preferably the same direction as the direction of said mechanical movement and more preferably stores said energy until the resetting mechanism is operated following which the biasing device preferably releases said energy and in so doing preferably moves said piston mechanism in a second direction to preferably return said piston mechanism to a starting position thereby resetting said setting tool.

Preferably, the piston mechanism is moved in the first direction by hydraulic fluid being pumped from a first chamber in fluid contact with a first side or face of the piston mechanism to a second chamber in fluid contact with a second side or face of the piston mechanism. More preferably, the piston mechanism is moved in the second direction by hydraulic fluid being moved from the second chamber to the first chamber.

Typically, the hydraulic fluid is moved to the second chamber from the first chamber by the hydraulic fluid pump which results in movement of the piston mechanism in the first direction. Preferably, upon actuation of the resetting mechanism, the biasing device releasing the said stored energy which causes the piston mechanism to move in the second direction and which causes the hydraulic fluid to move from the second chamber to the first chamber.

Preferably, the resetting mechanism comprises a pressure release mechanism and which permits hydraulic fluid to flow from the second chamber back to the first chamber in order to reset the tool for a future setting operation. Typically, unless and until the resetting mechanism is actuated, pressurised hydraulic fluid is permitted to flow from the first chamber to the second chamber but is prevented from flowing back from the second chamber to the first chamber. Typically, the resetting mechanism comprises an obturation member which may preferably be a moveable plug and which may be moved by an operator between: — a first (setting) configuration in which hydraulic fluid is permitted to flow from the first chamber to the second chamber and is prevented from flowing from the second chamber to the first chamber; and a second (re-set) configuration in which hydraulic fluid is permitted to flow from the second chamber back to the first chamber.

Preferably, the moveable plug is located in an aperture formed in a housing of the setting tool and may be moved: — into a sealed relationship with a hydraulic fluid conduit such that no fluid may pass along the said hydraulic fluid conduit when the operator requires the first (setting configuration); and may be moved out of a sealed relationship with the said hydraulic fluid conduit such that fluid may pass along the said hydraulic fluid conduit when the operator requires the second (re-set) configuration.

Preferably, the moveable plug and the aperture are provided with corresponding and co-operating threads such that the plug may be moved in the aperture by means of rotating it with a suitable tool.

Preferably, the setting tool comprises a locking mechanism which resists movement of the piston mechanism in at least one of the first and second directions.

According to a further aspect of the present invention there is provided a locking mechanism for a downhole tool, the locking mechanism being adapted to resist movement of a piston mechanism in at least one of the first and second directions. Preferably, the downhole tool is a downhole setting tool for setting an apparatus downhole and which may be run into a downhole wellbore to set the apparatus downhole and which may then be pulled from the downhole wellbore and re-set for a subsequent operation.

More preferably, the locking mechanism resists movement of the piston mechanism in the first direction until at least a pre-determined pressure is reached in the pressurised hydraulic fluid in the second chamber. More preferably, the locking mechanism permits movement of the piston mechanism in the first direction once at least a pre-determined pressure is reached in the pressurised hydraulic fluid in the second chamber. The locking mechanism thereby preferably permits testing such as diagnostic testing of the tool to occur up to the pre-determined pressure without causing the piston mechanism to move in the first direction thereby not causing the setting tool to set the downhole apparatus.

Typically, the locking mechanism comprises a locking piston arrangement which is biased in a first direction into a locked configuration by a locking biasing device. Preferably, movement of the locking piston arrangement in the second direction against the biasing device overcomes the biasing action of the biasing device and results in an unlocked configuration of the locking mechanism.

Preferably, the locking mechanism further comprises a locking member which is selectively engageable with the said piston mechanism and the locking piston arrangement is further adapted such that: — when the locking piston arrangement is in the locked configuration, it prevents the locking member from disengaging with the said piston mechanism; and when the locking piston arrangement is in the unlocked configuration, it permits the locking member to disengage from the said piston mechanism.

Typically, the locking member disengages from the said piston mechanism by relative movement between the two in a radial direction with respect to the longitudinal axis of the setting tool which then permits longitudinal movement of the said piston mechanism with respect to the locking member and/or other parts of the setting tool. Typically the locking member comprises one of more dog members engageable with one or recesses formed on the piston mechanism.

Preferably, the setting tool comprises a visual indication unit adapted to display variable data and/or other variable information to an operator of the tool. Preferably, the visual indication unit is mounted on an outer part or outer housing of the setting tool.

According to a further aspect of the present invention there is provided a visual indication unit for a downhole tool, the visual indication unit being adapted to be mounted on an outer part or outer housing of the setting tool and being adapted to display variable data and/or other variable information to an operator of the downhole tool. Preferably, the downhole tool is a downhole setting tool for setting an apparatus downhole and which may be run into a downhole wellbore to set the apparatus downhole and which may then be pulled from the downhole wellbore and re-set for a subsequent operation.

Preferably, the visual indication unit is preferably outwardly facing such that an operator may view the visual indication unit without having to open the setting tool or otherwise interfere with the setting tool. Preferably, the visual indication unit comprises one or more visual displays preferably located beneath a window, the outer face of which is typically in contact with the outer environment and the inner face of which is preferably sealed from the outer environment such that the visual displays are protected from contacting downhole fluids. Preferably, the visual displays comprise one or more light displays and may be one or more LED's and may comprise a screen capable of displaying alpha-numeric characters and/or a graphical arrangement of a plurality of pixels and which may be used to display data and/or information to an operator.

Preferably, the setting tool further comprises a housing and more preferably further comprises a power source for supply of electric power to operate the hydraulic fluid pump.

Preferably, the setting tool further comprises electronic components connectable to the power source.

Typically, there is at least one module for accommodating the power source and the electronic components.

Preferably, the at least one module is connectable with the housing in a first configuration for downhole use and removable from the housing in a second configuration in which the at least one module and the housing are separable.

According to another aspect of the invention there is provided apparatus for use in a wellbore, the apparatus comprising:

a housing;

a power source for supply of electric power;

electronic components connectable to the power source;

at least one module for accommodating the power source and the electronic components;

wherein the at least one module is connectable with the housing in a first configuration for downhole use and removable from the housing in a second configuration in which the at least one module and the housing are separable.

According to another aspect of the invention there is provided downhole apparatus, the apparatus comprising:

a body;

a power source for the supply of electric power;

a module for accommodating the power source; and an end cap releasably connectable to the module;

wherein the apparatus is movable between a first configuration for use downhole wherein the module is at least partially housed within the body and secured thereto by the end cap; and a second configuration in which the end cap and the module are collectively removable from the body.

The body may be releasably connectable with the end cap such that in a connected configuration axial movement of the end cap causes corresponding axial movement of the module and rotational and radial force applied to at least one of the module or the end cap causes release of the end cap and the module.

According to another aspect of the present invention, there is provided a down-hole tool, said down-hole tool comprising:

an attachment module for attaching said tool to means for moving the tool within a bore-hole, and a linear chain of functional modules connected to said attachment module, said linear chain being formed of a plurality of discrete functional modules that are connected together, the arrangement being such that individual discrete modules of the chain can be removed from the chain for replacement without disassembling the entire chain.

Typically, each said functional module is capable of one or more of fluid, mechanical and electrical interaction with one or more adjacent functional modules in said chain.

Typically, said chain comprises an operations module that includes a source of electrical power and a controller provided within an outer housing, said operations module including an electrical interface at one end of said operations module for electrically coupling said operations module to a neighbouring functional module of said chain.

Optionally, said electrical power source and said controller are sealed within said outer housing.

The said controller is typically configured to control the operation of said tool and is further typically configured to interface with one or more sensors of said tool, and optionally to record data generated by said sensors.

Preferably, said source of power comprises one or more batteries, for example a plurality of discrete lithium-ion battery packs.

The said operations module further preferably comprises means for facilitating the proper alignment of said operations module electrical interface with an electrical interface of another module in said chain and said facilitating means preferably comprises a body that projects radially outwardly from a terminal connector portion of said operations module housing.

Typically, said terminal connector portion of said operations module housing is of a smaller diameter than the remainder of said operations module housing.

Preferably, said body is configured to locate within a complementary formation provided in a neighbouring module of said chain to thereby align said operations module electrical interface with the electrical interface of said neighbouring module. Typically, said body radially inwardly deforms before locating in the complementary formation provided in said neighbouring module.

Preferably, the electrical connector of said operations module can be used for interrogating and/or programming said controller.

Typically, the other end of said operations module is configured for attachment to said attachment module.

Preferably, said other end of said operations module and one end of said attachment module are each provided with a part of a two-part coupling mechanism, a first part of said mechanism being complementary to a second part of said mechanism. More preferably, said two-part coupling mechanism is configured so that relative rotation of said respective parts of said mechanism will not decouple one said part from the other.

Typically, said two-part coupling mechanism is configured so that one said part can only be decoupled from the other said part by sliding said attachment module relative to said operations module.

Typically, a first part of said mechanism comprises: — a generally horseshoe-shaped body comprised of a horseshoe-shaped peripheral wall that has a radially inwardly extending flange, said flange and said peripheral wall cooperating to define a recess within said horseshoe-shaped body, and a second part of said mechanism comprises a projecting generally tongue-shaped body having a radially outwardly flanged outer portion that is configured to side into said recess and a second portion configured to fit within the radially inwardly extending flange of said first part.

Preferably, said two-part coupling mechanism includes a two-part locating mechanism, the respective parts of said locating mechanism being configured to engage when said first part of said coupling mechanism is coupled with said second part of said coupling mechanism, said first and second parts of said locating mechanism acting to resist inadvertent decoupling of said two-part coupling mechanism and said first and second parts of said locating mechanism further preferably acting to aid selective axial and rotational alignment of said two-part coupling mechanism when alignment is required but permit axial alignment but permit relative rotation to occur between said first and second parts of said locating mechanism to occur when a particular stage in the coupling process is reached.

Typically, said first part of said locating mechanism comprises a projection and said second part of said locating mechanism comprises a socket into which said projection fits when the respective parts of said coupling mechanism are coupled together.

Typically, the first part of said locating mechanism comprises a domed projection and said second part of said locating mechanism comprises a dished recess. Preferably, one of the first and second parts of said locating mechanism are biased by a biasing device in a direction and more preferably, said direction is in a direction toward the other of said first and second parts when connected. Preferably, the biasing device prevents unwanted rotation occurring between the first and second parts but permits wanted rotation to occur between the first and second parts, wanted rotation typically being rotation above a level of torque required to overcome the biasing device. Accordingly, the locating mechanism provides the advantage that an operator can insert one part of the tool into another part of the tool and the locating mechanism keeps the first and second parts thereof in rotational alignment until a certain stage in the insertion of the said one part of the tool has been reached at which point, an operator may rotate the said one part of said locating mechanism relative to the said second part of the locating mechanism with more torque than the said level of torque and thereby overcome the biasing device.

The said attachment module and one or more functional modules of said chain may be provided with an externally visible indicator, said attachment module and said one or more functional modules of said chain being at least roughly aligned for connection when one said indicator is aligned with the other.

Preferably, the tool further comprises a communications module configured for external communication with control and/or sensing components of the tool.

Preferably, said communications module is configured to interface with the controller of said operations module when the modules of the chain are assembled together.

Typically, said communications module includes a wireless transceiver and circuitry for establishing a wireless interface for the wireless transmission and reception of signals.

Typically, said communications module includes an indicator for informing a user when said communications module is capable of wireless communications.

Preferably, said communications module is responsive to a signal from an external transmitter to enable said wireless interface.

Typically, said communications module includes an indicator for informing a user of a fault with a said functional module of said chain.

Typically, said communications module comprises means responsive to an external stimulus to turn on the controller of said operations module when the functional modules of said chain are connected together.

Typically, said communications module comprises a reed switch that is responsive to an external magnetic stimulus to turn on the controller of said operations module when the functional modules of said chain are connected together.

Preferably, a functional module at an end of the chain distal from said attachment module comprises a module for deploying apparatus into said bore hole.

The apparatus to be deployed may comprise a packer or a plug or another downhole tool that requires to be set into the well, typically by being mechanically actuated.

Preferably, one end of said deployment module is configured for coupling to the apparatus to be deployed and the other end of the deployment module is configured for coupling to another functional module of the chain.

Typically, said deployment module comprises a mechanical connector configured to be capable of being coupled to apparatus to be deployed.

Typically, said mechanical connector is provided towards a distal end of a deployment piston that is axially moveable into to a peripheral annular shroud to decouple said mechanical connector from said apparatus to be deployed.

Typically, said annular shroud is configured to bear on said apparatus to be deployed as said deployment piston is axially withdrawn into the shroud.

Preferably, a proximal end of said deployment piston is moveable into a cylinder provided within a hydraulic fluid directing part of said deployment module.

Typically, said cylinder includes a compressible fluid, such as a gas, so that said deployment piston compresses said fluid as the proximal end of said deployment piston moves into the cylinder.

Typically, said deployment piston is coupled to an actuator piston, fluid pressure acting on said actuator piston causing said deployment piston to move relative to said shroud.

Typically, said deployment module includes a fluid supply part in fluid communication with said fluid directing part, and a pump for pumping fluid from a reservoir in said first fluid supply part through a supply passageway in said fluid directing part to the actuator piston and thereby drive the actuator piston away from the shroud and the deployment piston into the cylinder in said fluid directing part of said deployment module.

Typically, said fluid directing part includes a return passageway so that fluid between the actuator piston and said fluid directing part can return to said fluid reservoir for pumping through said supply passageway as said actuator piston moves to drive the deployment piston into the cylinder.

Preferably, the tool further comprises a reset mechanism operable after deployment of the apparatus to be deployed to couple said fluid supply passageway to said return passageway, the arrangement being such that compressed fluid in said cylinder expands to drive said deployment piston and said actuator piston away from said fluid directing part and towards said shroud, and thereby drive fluid between the actuator piston and the shroud back through the supply passageway to thereby replenish the fluid reservoir in the fluid supply part.

According to a further aspect of the present invention, there is provided a down-hole tool comprising: an attachment module having a distal end that is coupled to an operations module having the features of any of another aspect of the present invention, a distal end of said operations module being coupled to a communications module according to another aspect of the present invention, and a distal end of said communications module being coupled to a deployment module according to another aspect of the present invention.

According to a further aspect of the present invention, there is provided an operations module for use in the tool according to another aspect of the present invention.

According to a further aspect of the present invention, there is provided an communications module for use in the tool according to another aspect of the present invention.

According to a further aspect of the present invention, there is provided a deployment module for use in the tool according to another aspect of the present invention.

According to a further aspect of the present invention, there is provided an attachment module for a down-hole tool and an operations module for a down-hole tool, wherein:

the attachment module has a proximal end that is configured for attachment to means for moving a down-hole tool within a bore-hole, and a distal end that includes a first part of a two-part coupling mechanism, said first part comprising a generally horseshoe-shaped body comprised of a horseshoe-shaped peripheral wall that has a radially inwardly extending flange, said flange and said peripheral wall cooperating to define a recess within said horseshoe-shaped body, and the operations module comprises a source of electrical power and a controller provided within an outer housing, a proximal end of said housing including a second part of said two-part coupling mechanism, said second part comprising a projecting generally tongue-shaped body having a radially outwardly flanged outer first portion that is configured to slide into said recess and a second portion configured to fit within the radially inwardly extending flange of said first part, a distal end of said housing including an electrical interface for electrically coupling said operations module to a functional module of a down-hole tool.

All aspects of the present invention, and preferred, optional or typical features disclosed herein can be combined with one another and with any other feature in any, or multiple combinations where appropriate.

BRIEF DESCRIPTION OF THE DRAWINGS

Embodiments of the invention will now be described with reference to the accompanying drawings in which.

DETAILED DESCRIPTION

Figure 1:
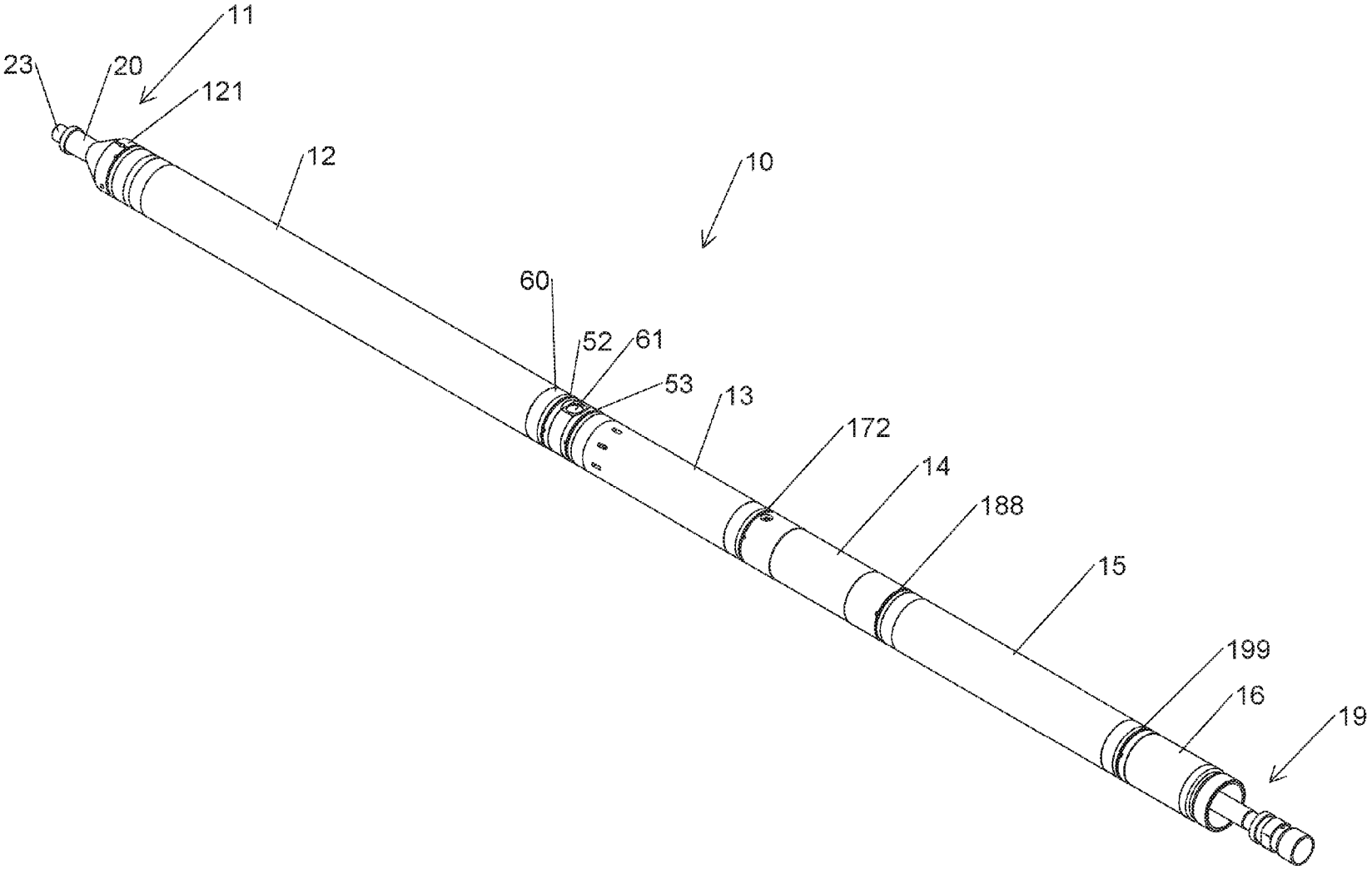
FIG. 1 is a perspective view of a downhole setting tool according to a first aspect of the invention.

A setting tool according to one embodiment of the invention is shown generally at 10 in FIG. 1. The setting tool 10 has an upper end 11, which remains closest to the surface when the tool 10 is deployed downhole in use and a lower end 19 which is located proximate the apparatus to be set when the tool is in use downhole. Accordingly the terms 'upper' and 'lower' as used herein are intended to refer to parts of a component or subcomponent that are located uphole or downhole, respectively relative to another part of that same component or subcomponent. These terms are used in a relative sense only and are not to be construed as limiting the disclosure in any way.

Figure 2:
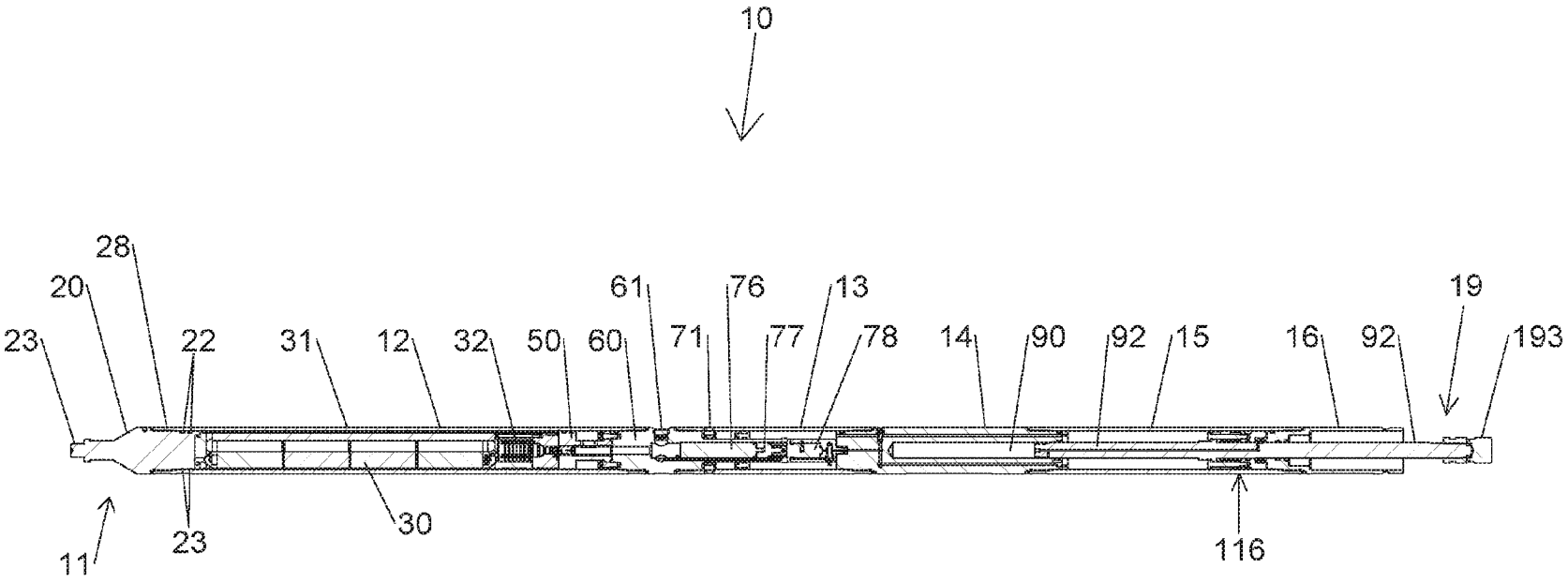
FIG. 2 is a sectional view of the setting tool of FIG. 1.

The exterior of the tool 10 shown in FIG. 1 comprises several parts: a top sub 20; an anti-rotation ring 121, an upper housing 12, a window portion 60 with upper and lower anti-rotation rings 52, 53 respectively, a middle housing 13, an anti-rotation ring 172, a spring piston housing 14, an anti-rotation ring 188, a lower housing 15, an anti-rotation ring 199 and a connector sub 16. As shown in FIG. 2, an end connector 193 extends on a stroke piston 92 from the interior of the tool 10 at its lower end 19.

Figure 3:
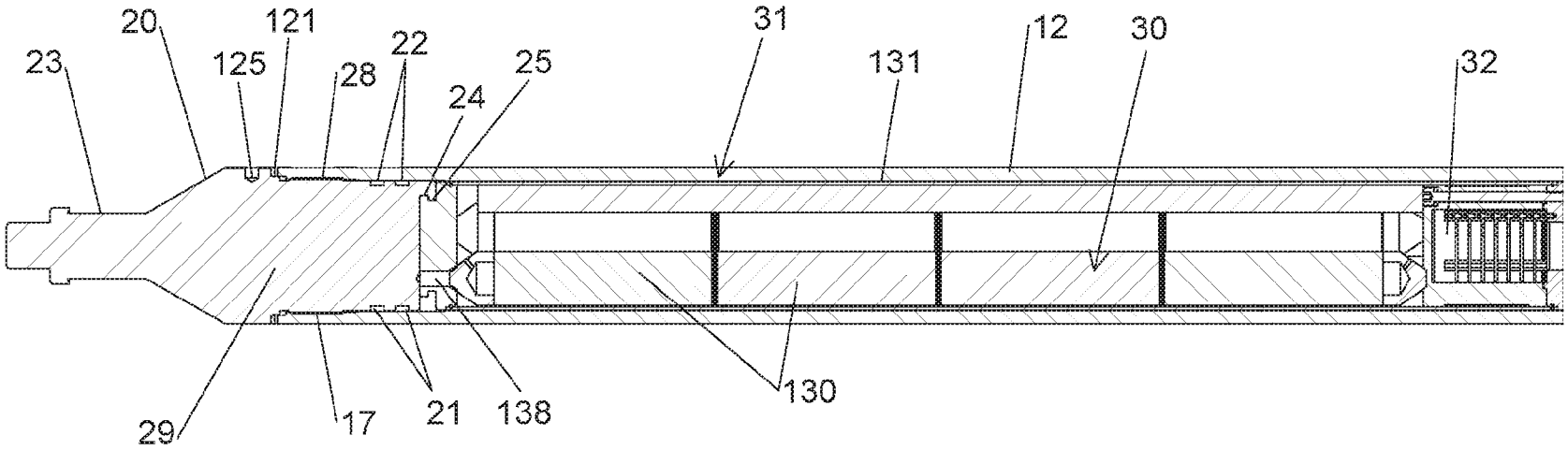
FIGS. 3 to 6 are detailed sectional views of portions of the tool shown in FIG. 2.
Figure 7:
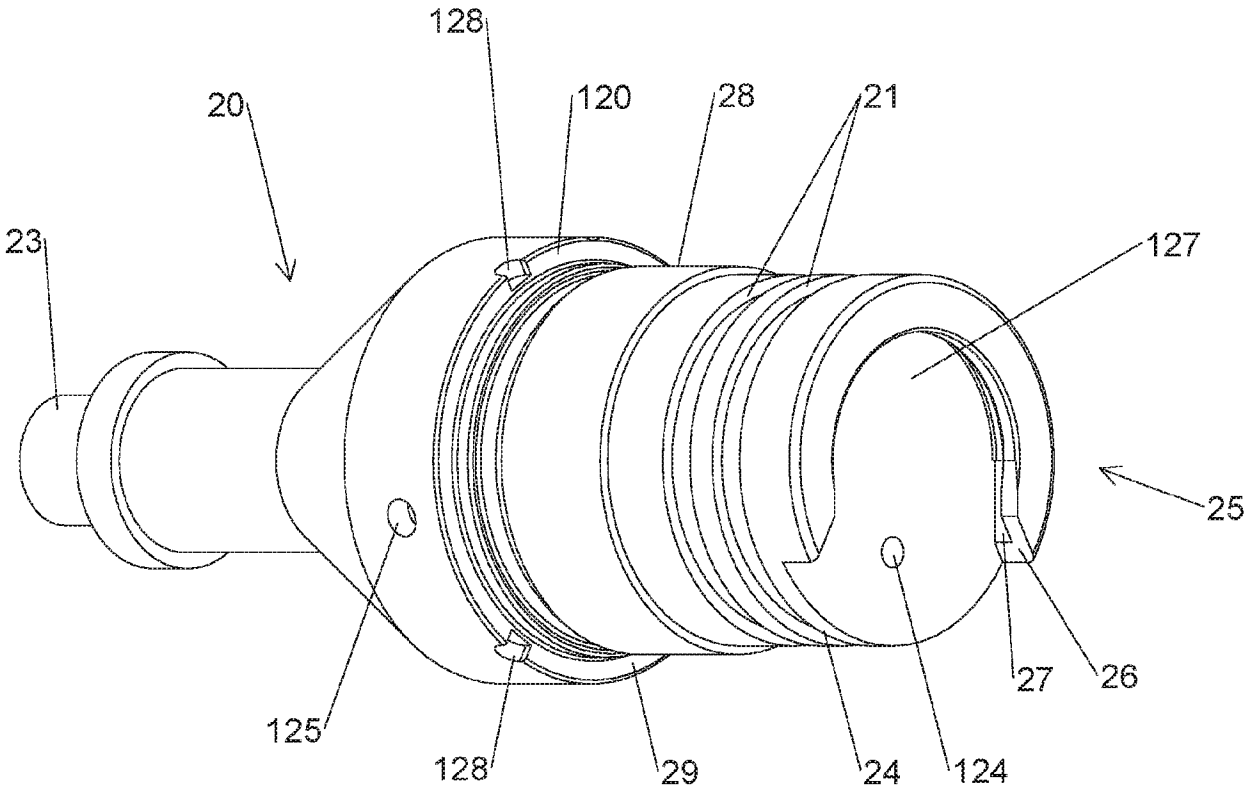
FIG. 7 is a perspective view of a top sub of the tool of FIG. 1.

A detailed view of the top sub 20 is shown in FIGS. 3 and 7. The top sub 20 is a solid steel component having an upper end 23 with a reduced diameter and external threads for industry standard threaded connection to slickline (not shown). An alignment notch 125 is provided on an external surface of the top sub 20 for alignment with a viewing window 61 located in the window portion 60 of the tool 10 in use. An annular downwardly facing shoulder 120 defines a step along which three radially equispaced anti-rotation slots 128 are located. A middle portion 29 of the top sub 20 has external threads machined on an outer surface to create a threaded pin connector 28. Towards a lower end 24, the top sub 20 is provided with two parallel annular grooves 21, each of which houses an o-ring seal 22 (FIG. 3). The lower end 24 of the top sub 20 has a horseshoe connector 25 comprising a c-shaped radially inward projection or lip 26 defining a c-shaped groove 27 therebeneath. A lower end face 127 of the top sub has a detent hole 124 centrally positioned between the ends of the c-shaped lip 26.

Figure 21:
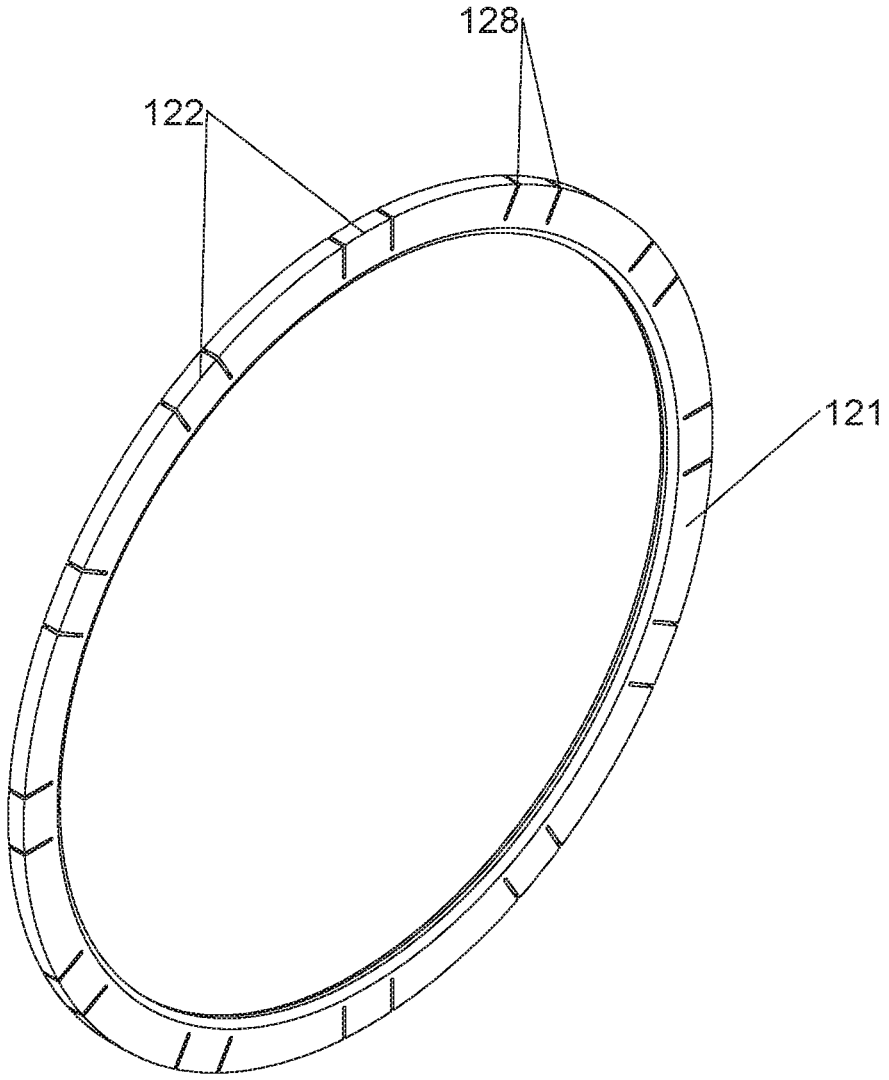
FIG. 21 is a perspective view of an anti-rotation ring of the tool of FIG. 1.

The anti-rotation ring 121 is located between the top sub 20 and the upper housing 12 (FIG. 3). As shown in FIG. 21, the anti-rotation ring is a flat annular ring having twelve radially equispaced tabs 122 defined by a series of radial slots 128 cut into the ring 121. During assembly and before use of the tool 10, the anti-rotation ring 121 is slipped over the lower end of the top sub 20 and positioned adjacent the downwardly facing annular shoulder 120. Once the upper housing 12 is secured in position adjacent the antirotation ring 121, the tabs 122 are deformed into the three slots 128 of the top sub 20.

Four tabs 122 of the anti-rotation ring 121 are deformed in the opposing direction for accommodation in similar anti-rotation slots (not shown) in the upper housing 12. Thus, the anti-rotation ring 121 resists relative rotational movement of the top sub 20 and the upper housing 12 in use.

The upper housing 12 is a hollow cylindrical steel tubular with an upper box threaded connector 17 and a lower box threaded connector 18. A bore of the upper housing 12 is dimensioned to accommodate an electronics power unit 31.

Figure 19:
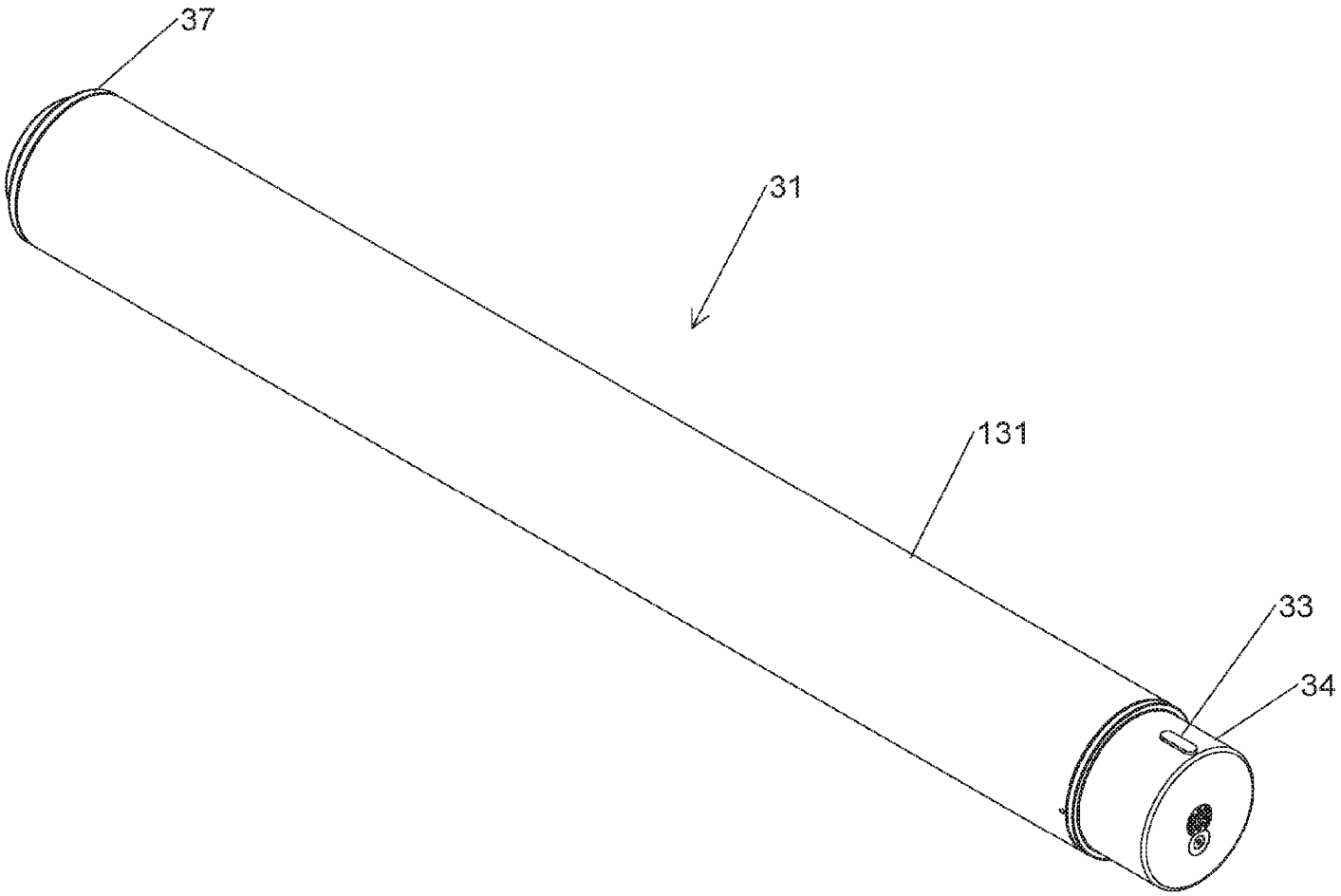
FIG. 19 is a perspective view of an electronics power unit subassembly of the tool of FIG. 1.
Figure 20:
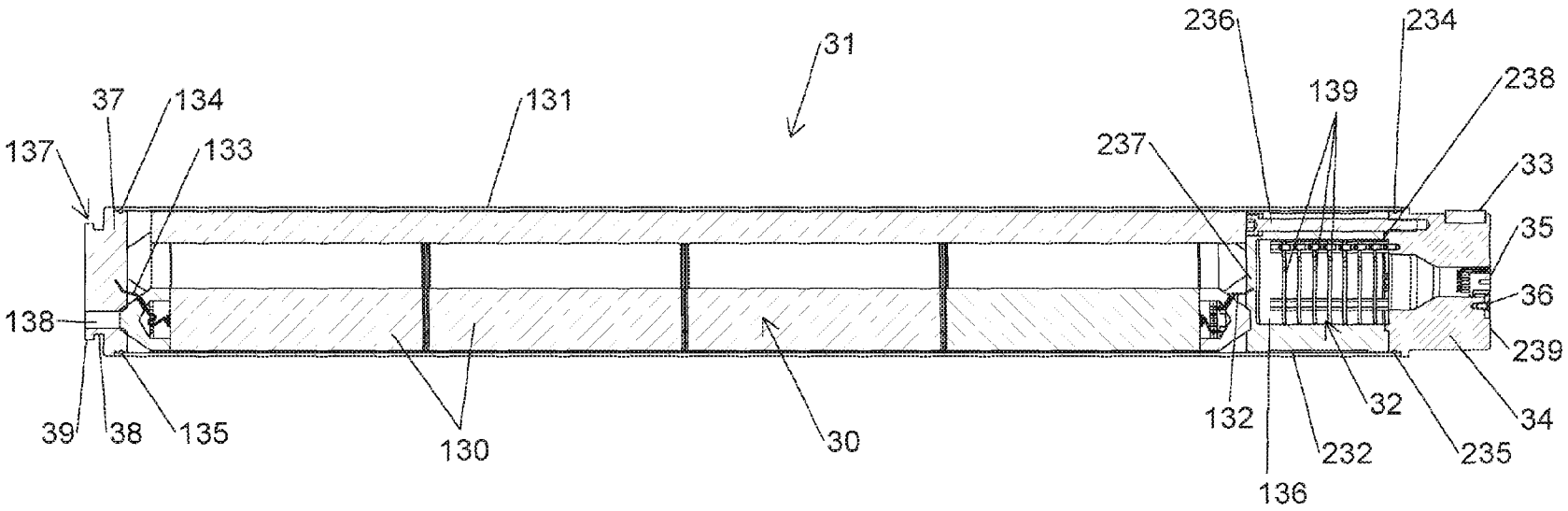
FIG. 20 is a sectional view of the electronics power unit subassembly of FIG. 19.

The electronics power unit (EPU) 31 (shown in FIGS. 19 and 20) is a removable and replaceable subassembly. In use, the EPU 31 functions to power and control actuation of the tool 10. Outer components of the EPU 31 include an upper end cap 37, a cylindrical hollow anodised aluminium tubular housing 131 and a lower end cap 34, which are interconnected to form a closed cylindrical casing that houses batteries 30 and an electronics pack 32.

Figure 8:
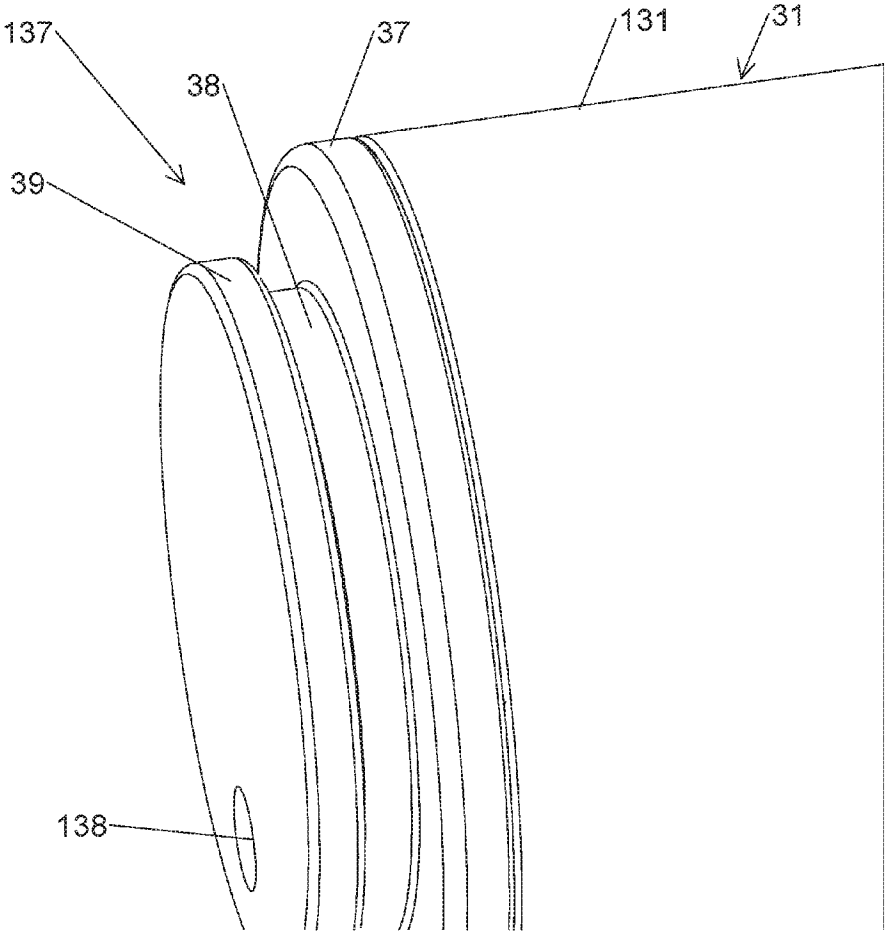
FIG. 8 is a partial perspective view of an upper end of an electronics power unit of the tool of FIG. 1.

A detailed view of the upper end cap 37 in shown in FIG. 8. The upper end cap 37 has an end connector 137 comprising an annular projection 39 defining an annular slot 38 therebeneath. The annular projection 39 of the end connector 137 is sized to interlock with the c-shaped groove 27 of the top sub 20 horseshoe connector 25. The end connector 137 is provided with a detent mechanism 138 embedded therein. The detent mechanism (not shown) includes a ball that is spring biased to form a partially spherical protrusion extending from an end face of the end connector 137 and, in use, the said ball (not shown) will be biased into the detent hole 124 of the top sub 20 to ensure correct rotational alignment therebetween. An annular groove 134 (shown in FIG. 20) provided on a lower external surface of the end cap 37 accepts a plurality of balls 135 to axially lock the end cap 37 to the EPU 31 housing 131.

The batteries 30 comprise a series of interconnected primary lithium cells 130 or other suitable batteries. Lower wires 132 (FIG. 20) connect the lower terminals of the cells 130 with the electronics pack 32. Similarly upper wires 133 extend from an upper end of the batteries 30 and run parallel with and along the length of the batteries within the housing 131 to connect the upper terminals of the cells 130 with the electronics pack 32. The batteries 30 can be provided with temperature sensitive labels (not shown) to indicate maximum temperatures reached during downhole use.

The electronics pack 32 is located within a metal bulkhead 136. The bulkhead 136 is a cylindrical housing with a closed end 237 and an open end 238 into which the electronics pack 32 is inserted. The bulkhead 136 serves to protect the electronics pack 32 against shock loads that the tool 10 may experience downhole in use. An external surface of the bulkhead 136 has two parallel axial slots (not shown) for accommodating the upper and lower wires 133, 132 that connect the batteries 30 and the electronics pack 32. The external surface of the bulkhead 136 also has an annular recessed portion 232. The recessed portion 232 allows fixing means such as tape to secure the upper and lower wires 133, 132 in their respective axial slots. The bulkhead 136 is bolted to the end cap 34 by means of a bolt 236.

The electronics pack 32 includes a series of stacked interconnected printed circuit boards (PCBs) 139. A pocket (not shown) is milled within the bulkhead 136 adjacent one of the PCBs 139 to accommodate a temperature sensor (not shown). The temperature sensor is wired into one of the PCBs 139 within the electronics pack 32. In addition, components such as accelerometers, vibration sensors, motion sensors (none shown) and other electronic equipment for logging downhole parameters are electronically coupled to the PCBs 139. A timer (not shown) is provided on one the PCBs 139. The PCBs 139 contain electronic circuitry programmed to log, process and respond to certain data obtained by the electronics pack 32 components and equipment measuring downhole conditions. The end cap 34 secures the electronics pack 32 within the bulkhead 136 by means of the bolt 236.

Figure 4:
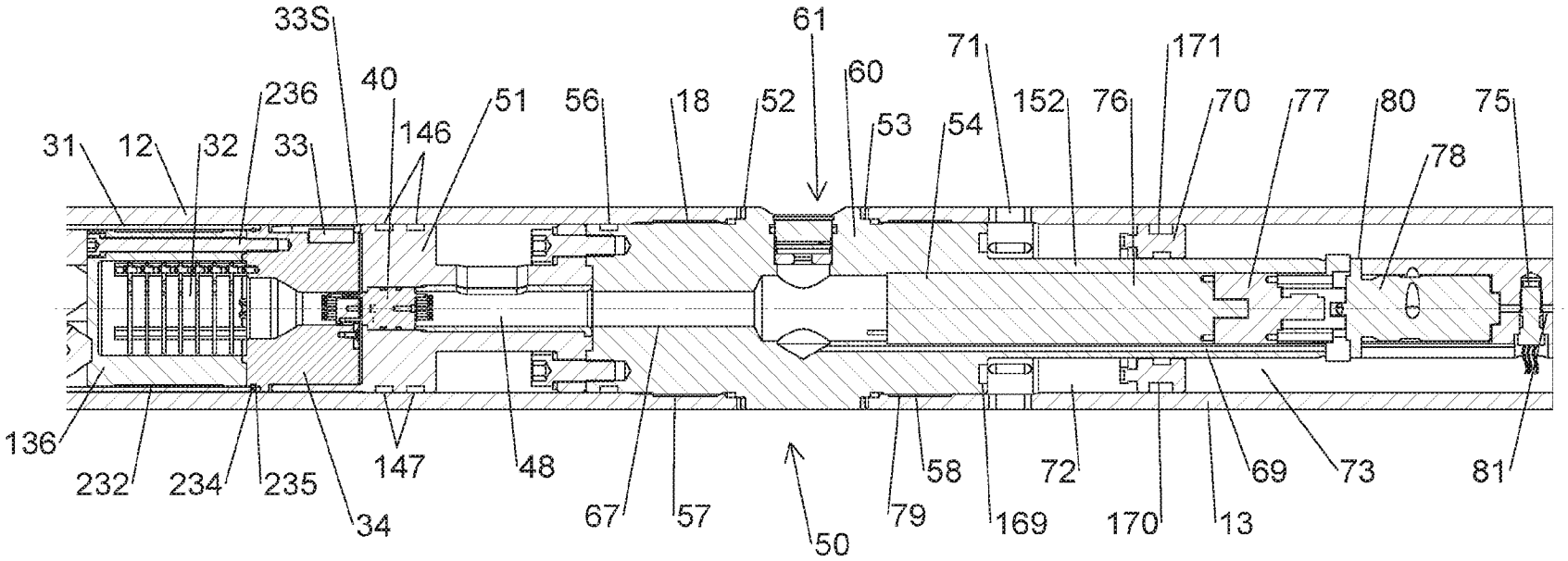
Figure 9:
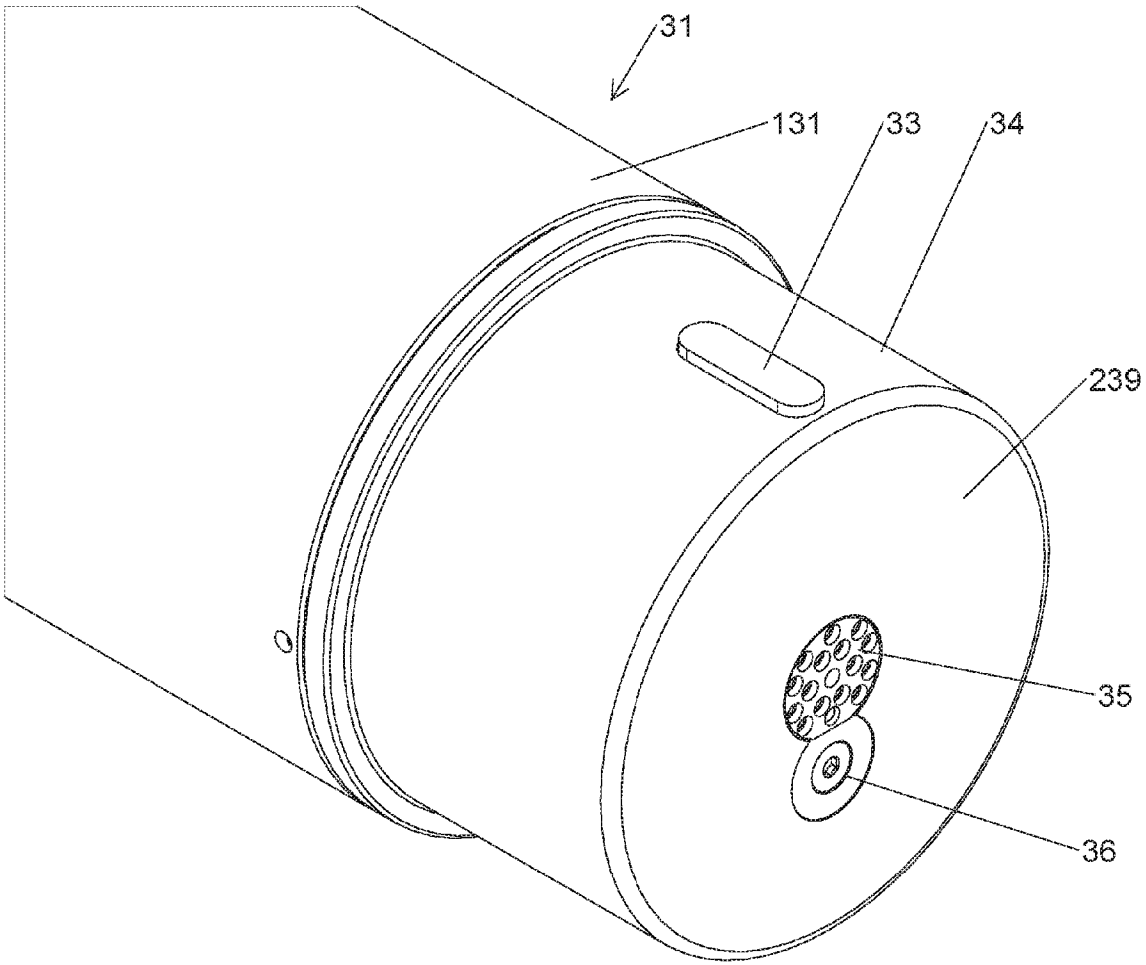
FIG. 9 is a partial perspective view of a lower end of the electronics power unit of FIG. 8.

The end cap 34 is a generally cylindrical metal solid cap. An upper external surface of the end cap 34 has an annular groove 234 into which a plurality of balls 235 are inserted to axially lock the end cap 34 to the EPU 31 housing 131. A lower external surface of the end cap 34 is provided with an axially and radially extending key 33 which projects into and is held rotationally by an axially extending slot 33S formed in the inner surface of the upper housing 12 to ensure correct alignment of the EPU 31 within the upper housing 12 of the tool 10 (FIG. 4). A lower end face 239 of the end cap 34 has a fifteen pin socket 35 that provides a connection means to the PCBs 139 via wires extending from a lower end of the electronics pack 32. The lower end face 239 (FIG. 9) is also provided with an orientation washer 36 adjacent the socket 35. The orientation washer is adapted to receive a mating pin connection 41 (FIG. 10) that ensure correct alignment of the socket 35 and cooperating pins 42.

Figure 5:
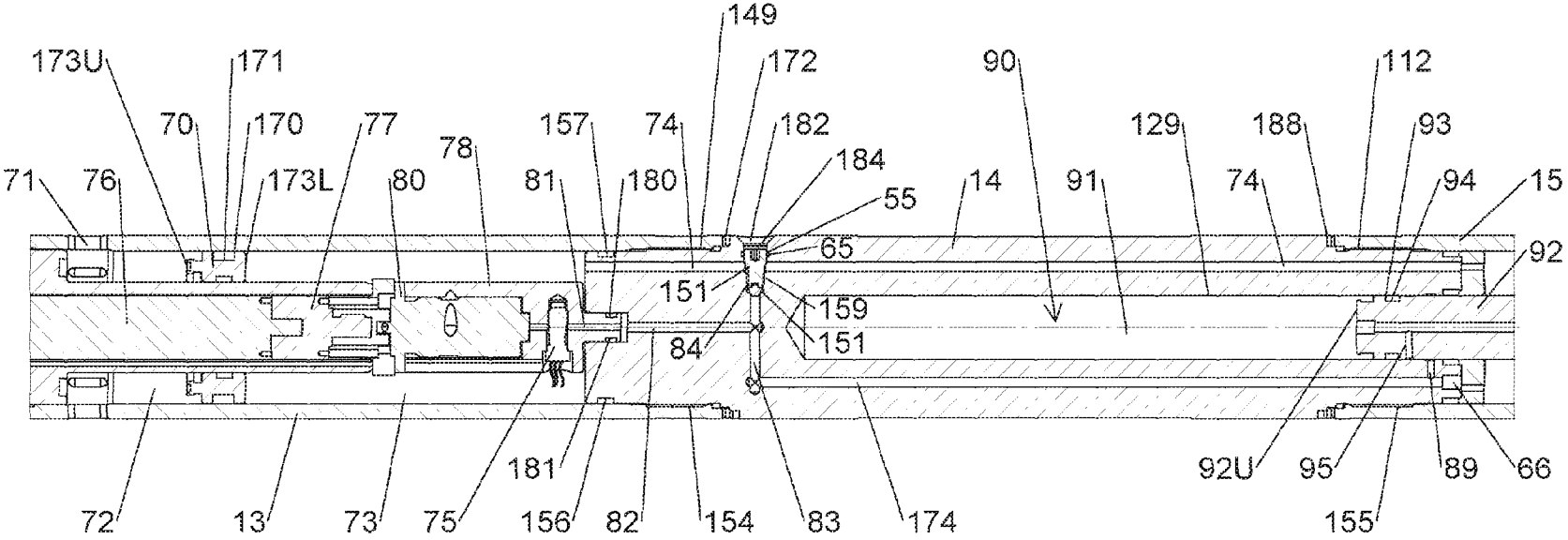
Figure 11:
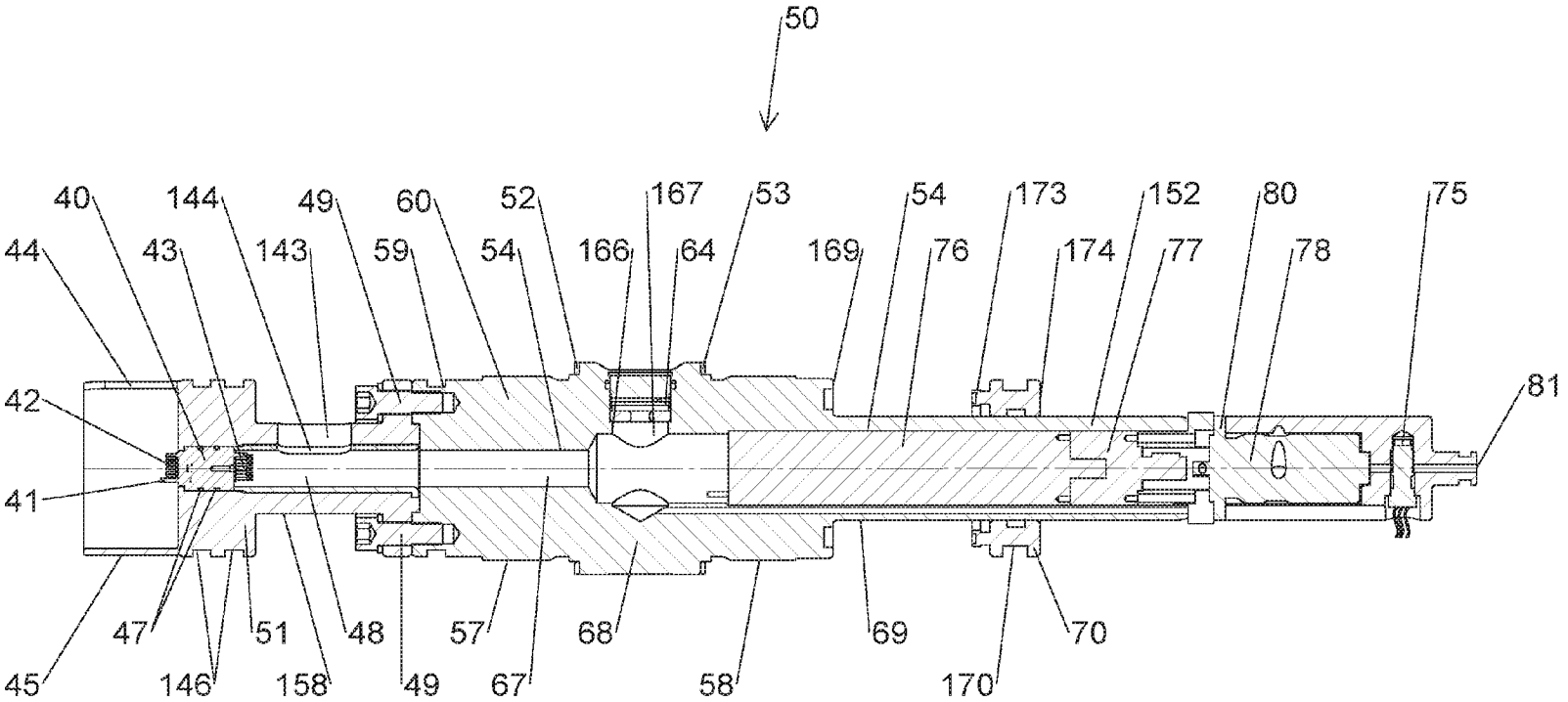
FIG. 11 is a sectional view of an electromechanical subassembly of the tool of FIG. 1.

An electromechanical (EM) subassembly 50 is shown in FIG. 11. The EM subassembly 50 is located within a portion of the upper housing 12 and the middle housing 13 of the tool 10. An upper end of the EM subassembly 50 mates with the lower end cap 34 of the electronics power unit 31 (FIG. 4). A lower end of the EM subassembly 50 is connectable with the spring piston housing 14 (FIG. 5).

The electromechanical subassembly 50 includes a bulkhead 51 at its upper end. The bulkhead 51 has a hollow cylindrical female end 45 arranged to accept the end cap 34 of the EPU 31. The female end 45 is provided with an axially extending keyway 44 on an inner surface. The keyway 44 is aligned with a central diameter of the viewing window 61 and accepts the key 33 on the EPU 31 end cap 34 to rotationally align the EPU 31 with the electromechanical subassembly 50. An exterior of the bulkhead 51 is provided with two parallel annular grooves 146 that house o-ring seals 147 (FIG. 4).

Figure 10:
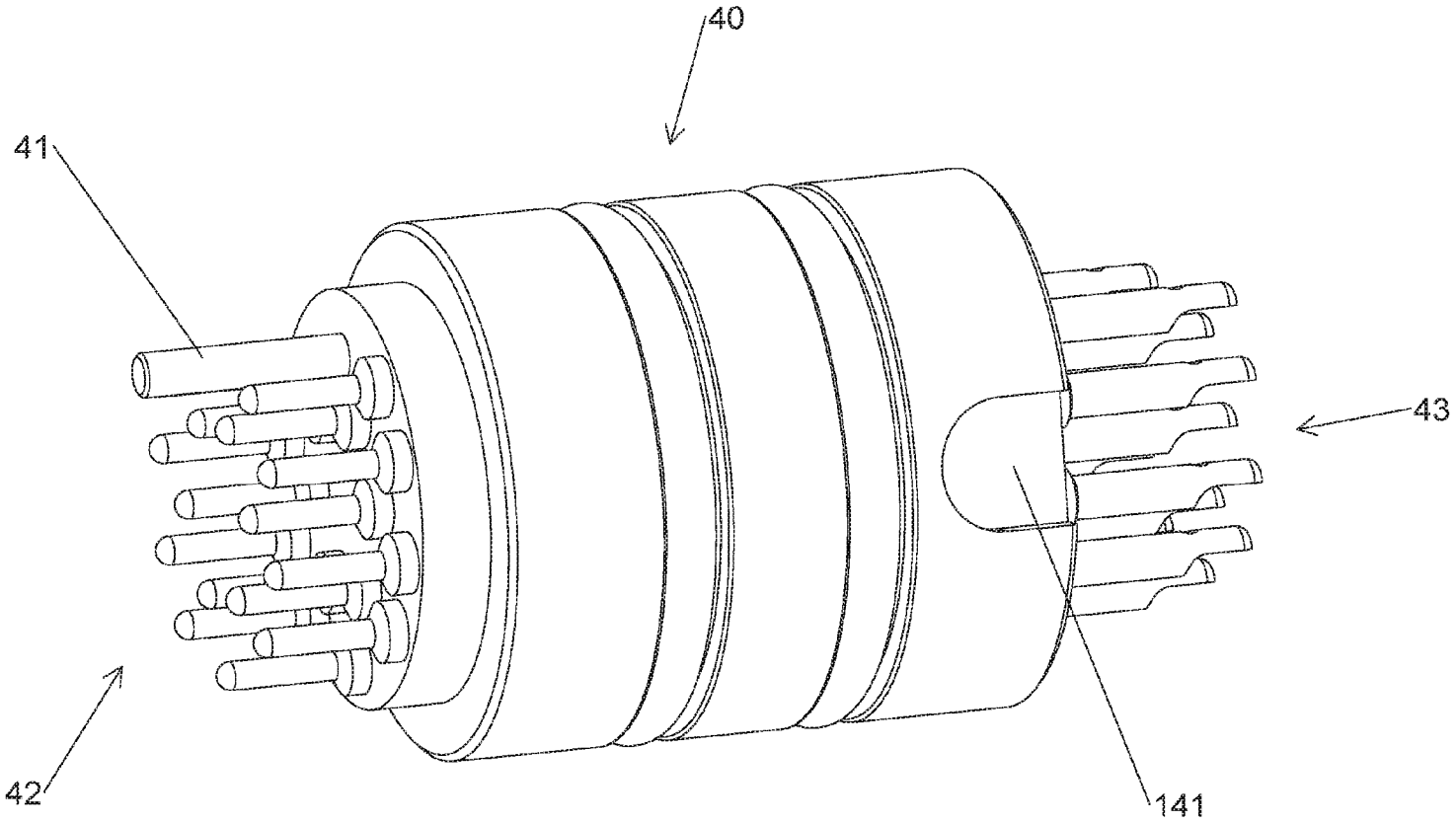
FIG. 10 is a perspective view of a connector of the tool of FIG. 1.

The EM subassembly 50 bulkhead 51 accommodates an electric connector 40 and a wire housing 48 (shown in FIG. 11). A detailed view of the connector is shown in FIG. 10.

The connector 40 has fifteen upper electrical pins 42 and fifteen lower electrical pins 43 although it should be noted that the connector 42 could be modified to have a different number of pins 42, 43 as required.

An upper end of the connector 40 is also provided with the alignment pin 41 for engagement with the orientation washer 36 in the end cap 34. An external lower surface of the connector 40 has an alignment slot 141 to ensure correct alignment with the wire housing 48. The wire housing 48 provides a protective casing around wires extending between the lower pins 43 of the connector 40 and the other electronic components within the EM subassembly 50. A middle region of the bulkhead 51 has a reduced diameter portion 158. The reduced diameter portion 158 has a slot 143 cutaway allowing access in one radial position to the wire housing 48. The wire housing 48 also has a slot 144 cutaway in the same region to allow wires (not shown) extending from the lower pins 43 to be connected with wires extending from a pressure transducer 75 and other electronic components within the EM subassembly 50. The bulkhead 51 is bolted by means of bolts 49 to the window portion 60 of the tool 10. The window portion 60 of the tool 10 accommodates visible indictors and supporting electronics regarding the state of the tool 10. The window portion 60 is a substantially cylindrical steel component having a hollow bore 54 that houses electrical and mechanical components.

The window portion 60 has an upper annular groove 59 for housing an o-ring seal 56 (FIG. 4). The window portion 60 has upper and lower threaded pin connectors 57, 58 respectively. The upper pin connector 57 is arranged to engage the lower threaded box connector 18 of the housing 12. A central area 68 of the window portion 60 has an increased outer diameter, such that the outer diameter of the central area 68 window portion 60 in this region is equal to the outer diameter of the tool 10 housing portions 12, 13, 15. Thus, the central area 68 of the window portion 60 forms an outer surface of the tool 10. Upper and lower anti-rotation rings 52, 53 (identical to the anti-rotation ring of FIG. 21) are positioned immediately adjacent the central area 68 increased diameter portion.

An axially extending wire housing 67 within the window portion 60 provides a continuation of the protective casing provided by the wire housing 48. Wires (not shown) extend within the wire housing 67 to electrically connect wires extending from the lower pins 43 to other electronic components within the tool 10. A hollow cylindrical wire housing 167 extends in a radial direction perpendicular from the wire housing 67. The wire housing 167 is provided for carrying wires (not shown) from the wire housing 67 to a visible printed circuit board (PCB) 64 (FIG. 11).

Figure 12:
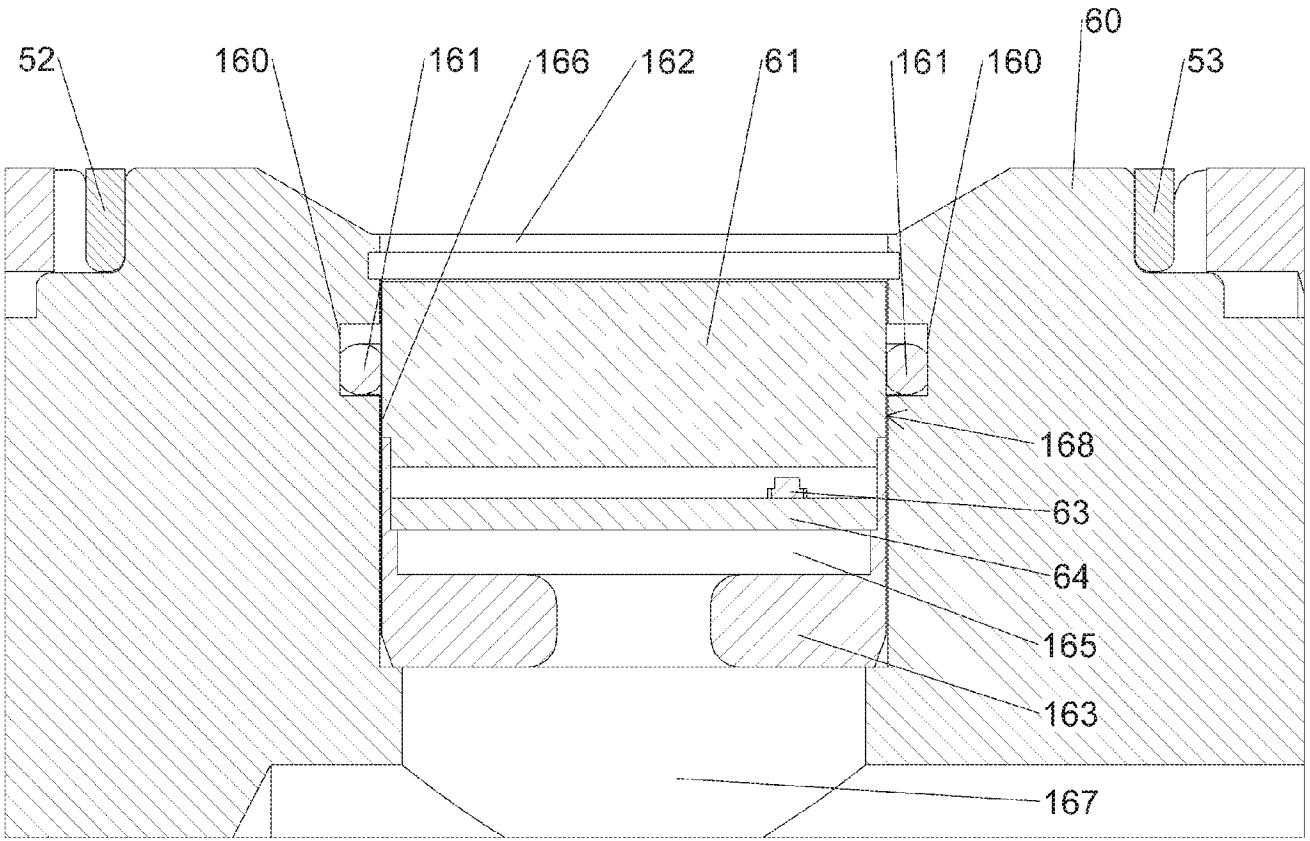
FIG. 12 is a detailed sectional view of part of a window portion of the tool of FIG. 1.
Figure 13:
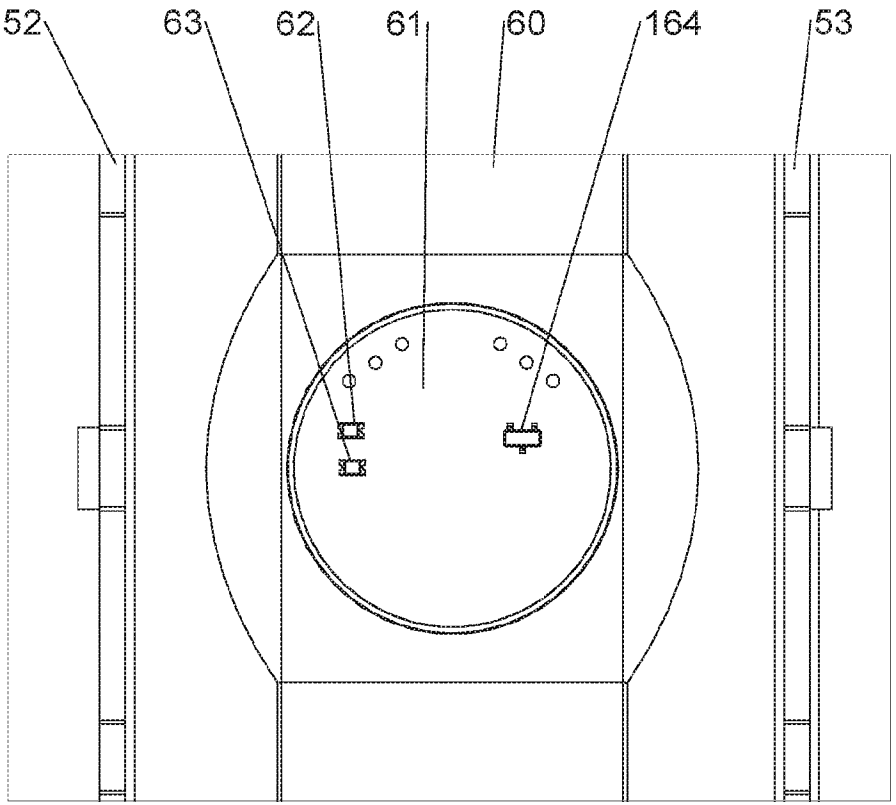
FIG. 13 is a top view of a viewing window of the tool of FIG. 1.
Figure 14:
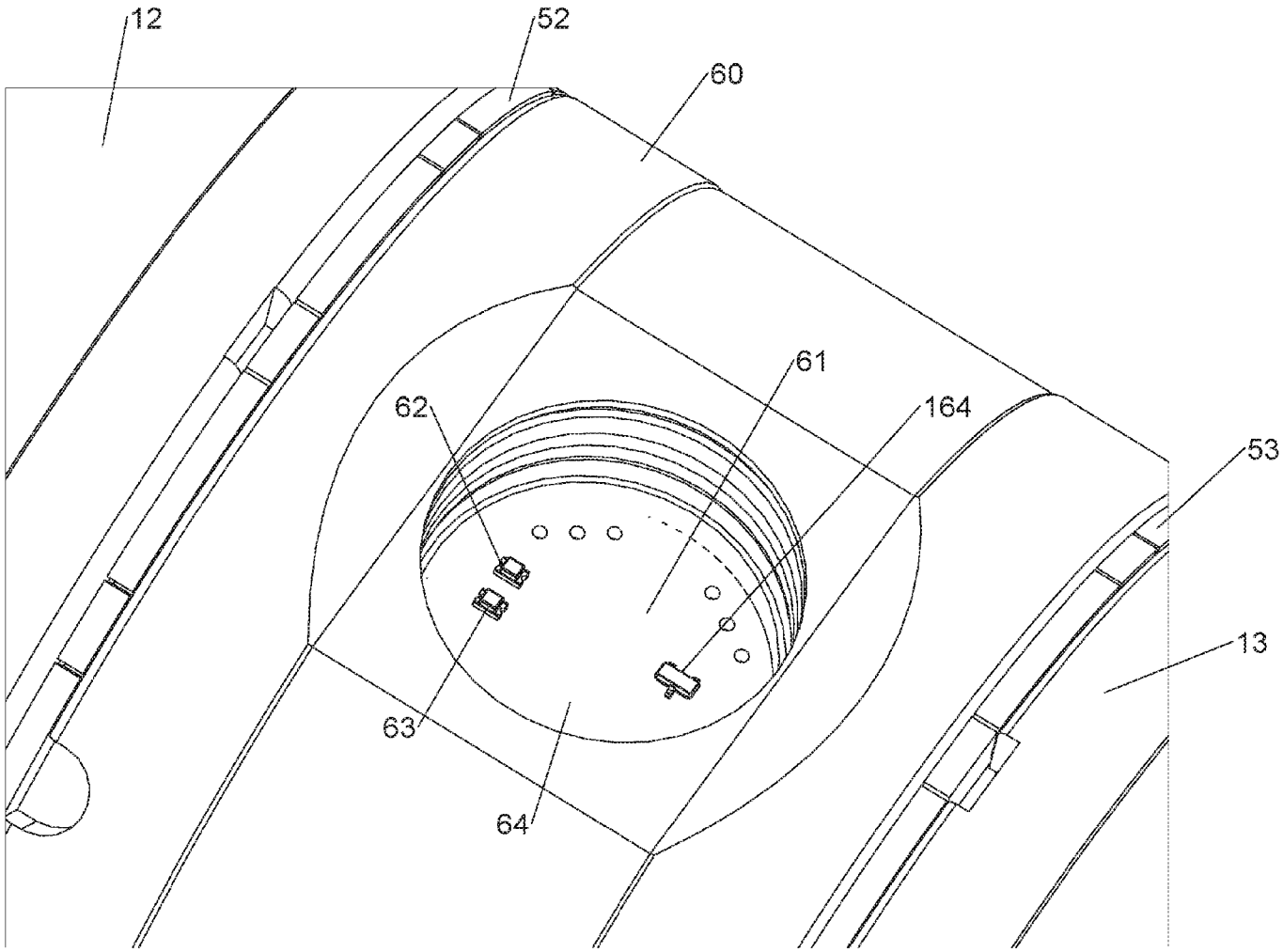
FIG. 14 is a partial perspective view showing the viewing window of FIG. 13.

A cylindrical hollow 166 (FIG. 11) extending radially from the hollow bore 54 is machined in the window portion 60. The cylindrical hollow 166 houses a viewing assembly module 168 (FIG. 12). The viewing assembly module 168 includes the printed circuit board 64 mounted on a metal base stand 165 (FIG. 12). The area surrounding the stand 165 and PCB 64 is encased in resin 163. The PCB 64 carries a suitable visual indication means such as a red light emitting diode (LED) 62 and a blue LED 63 mounted thereon. The PCB 64 also carries a suitable wireless data transceiver means such as a Bluetooth™. transmitter (not shown) and a magnetic sensor 164 as shown in FIGS. 13 and 14. A sapphire glass viewing window 61 is located above the resin 163 encased PCB 64. A circular groove 160 is cut in the window portion 60 surrounding the cylindrical hollow 166. An o-ring seal 161 is located in the groove 160 to fluidly isolate the PCB 64 and internal electronics. The glass viewing window 61 is retained in place by an annular rim 162 held in position by a brass circlip (not shown). The PCB 64 and LEDs 62, 63 are visible to an operator through the viewing window 61 to provide a visual indication of the state of the tool 10.

A lower end portion 152 of the EM subassembly 50 has an increased bore 54 diameter that houses a motor 76, a gearbox 77, a pump 78 and the pressure transducer 75. The motor 76, gearbox 77 and pump 78 are all electrically actuated components that provide the necessary drive and output to cause setting and actuation of the apparatus attached to the lower end 19 of the setting tool 10. The motor 76 is any suitable motor such as a brushless sensorless direct current motor. The gearbox 77 is any suitable gearbox compatible with the motor 76. The pump 78 is any suitable standard downhole pump having an inlet 80 and an outlet 81 having a non return valve (not shown). A protective housing 69 (FIG. 4) is provided within a sidewall of the lower end portion 152. The protective housing 69 extends axially to carry wires (not shown) between the wire housing 67 and the pump 78, gearbox 77 and pressure transducer 75.

An upper threaded box connector 79 of the middle housing 13 enables connection of the window portion 60 and the middle housing 13 via the lower threaded pin connector 58 of the window portion 60. An annular balance piston 70 (FIG. 5) is slidably coupled to the exterior of the lower end portion 152. The balance piston 70 has an external annular groove 170 for housing an annular seal 171 (FIG. 4) to provide a sliding seal between the piston 70 and an interior of the middle housing 13. Optionally, a spring (not shown) can be provided between an end shoulder 169 (FIG. 11) of the window portion 60 and an upper face 173U of the balance piston 70 to bias the piston 70 downwardly, away from the end shoulder 169 and toward the pump 78 such that the piston 70 compresses hydraulic fluid located in a second chamber 73 to provide some positive hydraulic pressure to prime the pump 78 via the inlet 80.

The middle housing 13 has two radially spaced ports 71 extending through the sidewall of the housing 13 proximate the end shoulder 169 of the window portion 60. The ports 71 allow fluid communication between the ambient external environment and the upper face 173U of the piston 70 exposing the upper face 173U of the piston 70 to well fluids in use. Ambient fluid is admitted via the ports 71 into a first annular chamber 72 defined by an interior of the middle housing 13, the upper face 173U of the piston 70 and the end shoulder 169 of the window portion 60. On the lower side of the balance piston 70 a second annular chamber 73 contains clean hydraulic fluid. The second chamber 73 is defined by an interior of the middle housing 13, a lower end face 173L of the piston 70 and the interior of a portion of the spring piston housing 14. Both the first and second annular chambers 72, 73 are of variable axial length according to the ambient conditions and the state of the setting tool 10, although the tool 10 is designed such that minimal axial travel of the balance piston 70 should be required.

A threaded box end connector 149 at a lower end of the middle housing 13 engages a threaded pin connector 154 on the spring piston housing 14 to secure the middle housing 13 to the piston housing 14. An anti-rotation ring 172 is located therebetween and is identical to the anti-rotation ring of FIG. 21.

The spring piston housing 14 (FIG. 5) is a cylindrical block of metal having axial and radial chambers machined therein to accommodate the gas spring 90 and for the communication of hydraulic fluid. The spring piston housing 14 has an upper pin threaded connector 154 for threaded connection with the box threaded connector 149 of the middle housing 13.

The spring piston housing 14 is sealed against the interior of the middle housing by means of an o-ring 157 housed within an annular groove 156. An anti-rotation ring 172 is provided between the middle housing 13 and the spring piston housing 14.

Figure 6:
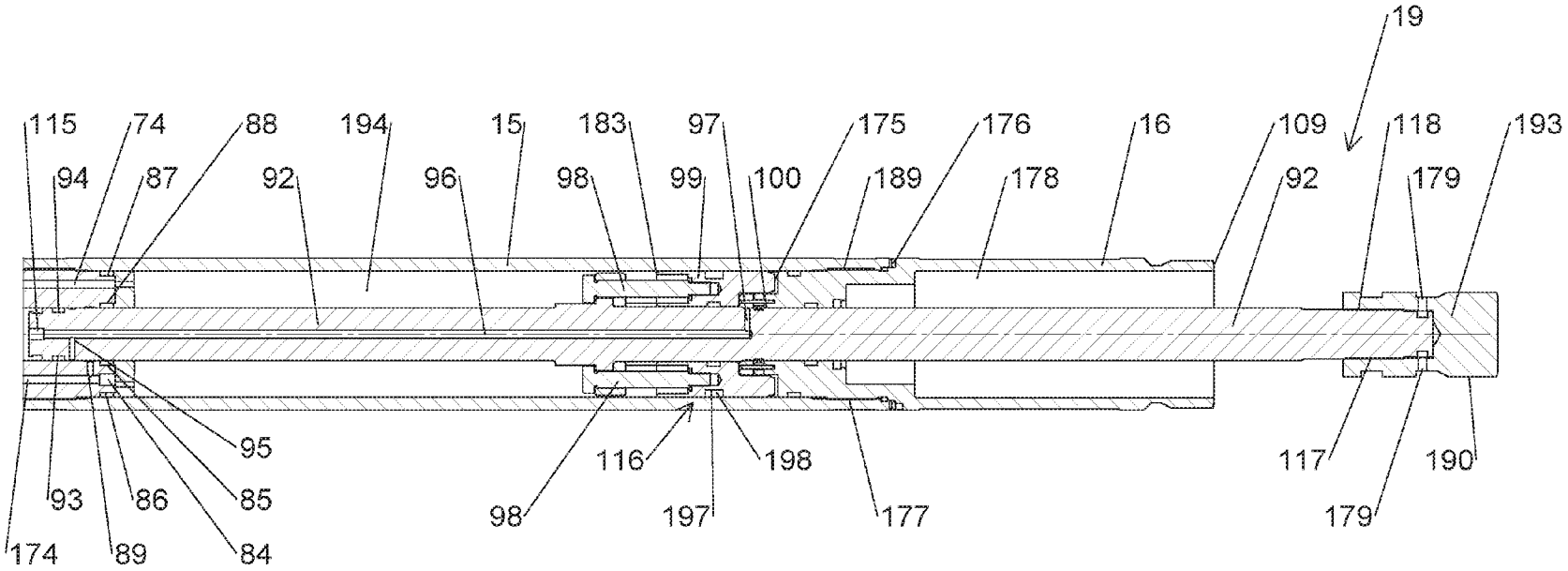

A bore 74 for carrying hydraulic fluid extends axially through a sidewall of the piston spring housing 14 fluidly connecting the second chamber 73 with a third annular chamber 194 (FIG. 6). The third annular chamber 194 is defined by an inner surface of the lower housing 15, an external surface of the stroke piston 92, part of the spring piston housing 14 and an upper end face 183 of an actuator piston 99. Thus the second fluid chamber 73 is in fluid communication with the third fluid chamber 194. Both the second and third fluid chambers 73, 194 contain clean hydraulic fluid.

The pump outlet 81 (FIG. 5) is connected to an axially extending bore 82 for carrying hydraulic fluid. The bore 82 extends centrally within the spring piston housing 14. Towards the end of the bore 82, a radially extending bore 83 carrying hydraulic fluid is fluidly connected and extends perpendicular therefrom. One end of the bore 83 has an increased diameter 151, which intersects the longitudinal bore 74. A portion of the bore 83 having increased diameter 151 is provided with threads 159 that mate with threads 186 on a plug 84. Thus the plug 84 obturates one end of the hydraulic line 83. The increased diameter portion 151 of the bore 83 opens into a port 182 that provides communication between the bore 83 and the exterior of the tool 10 to allow hydraulic fluid to be inserted into bore 83 and the rest of the hydraulic system and, when the hydraulic system has been filled, a plug 84 is inserted into port 182. Towards the port 182 in an end region of the increased diameter portion 151, an annular groove 55 is provided to house an o-ring seal 65. This seal 65 isolates the port 182 from the intersecting bore 74 when the plug 84 is threaded in place within the bore 83.

Figure 22:
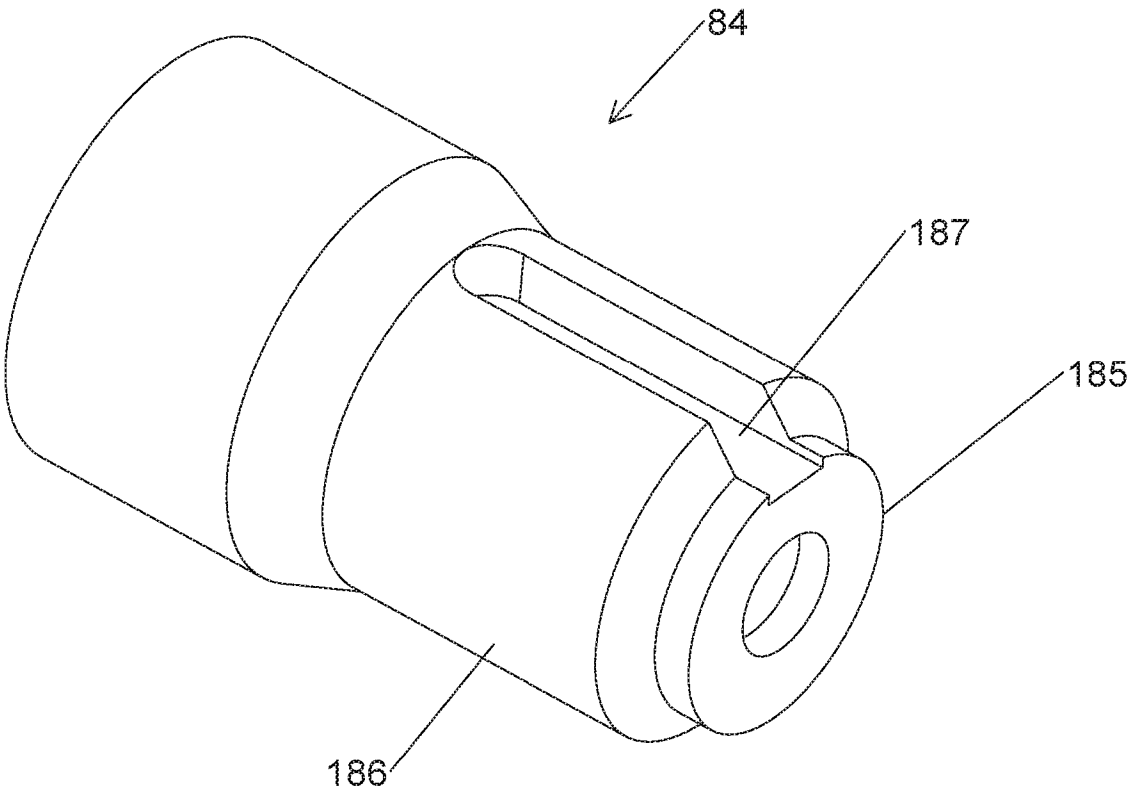
FIG. 22 is a perspective view of a pressure release plug of the tool of FIG. 1.

The plug 84 has a hexagonal end socket 184 such that the plug 84 can be rotated within the threaded 159 bore 83 using a conventional allen key (not shown). The plug 84 is shown in greater detail in FIG. 22. The plug 84 has a frustoconical end 185 having a variable outer diameter a middle part of which engages the end of the increased diameter portion 151 to thereby plug the bore 83. A longitudinal bypass slot 187 extends from the frustoconical end 185 across the threads 186 of the plug 84. The bypass slot 187 provides a route for fluid communication around the threads 186 of the plug 84 once the frustoconical end 185 is displaced from the bore 83. However, the plug 84 is shaped such that it permits hydraulic fluid to flow along bore 74 past the plug 84 at all times.

An opposite end of the radially extending bore 83 from the increased diameter portion 151, is fluidly connected to a perpendicular and longitudinally extending bore 174 (FIG. 5) that extends axially to an end of the piston spring housing 14. The end of the bore 174 is stopped and sealed by a plug 66. A radially extending bore 89 is fluidly connected perpendicular to the bore 174 towards its plugged end.

A central bore 129 (FIG. 5) within the spring piston housing 14 accommodates the gas spring 90. The stroke piston 92 is inserted and sealed within the central bore 129 by means of an annular seal 94 located within an annular groove 93 provided towards an upper end of the stroke piston 92. An upper face 92U of the gas spring piston 92 and the central bore 129 define a gas spring chamber 91.

The stroke piston 92 is mainly located within the lower housing 15 (FIG. 6). The lower housing 15 is a substantially cylindrical hollow tubular. At an upper end, the lower housing 15 has an upper threaded box connector 112 (FIG. 5) for engagement with a lower threaded pin connector 155 of the piston housing 14. A lower end of the piston housing 14 is sealed around the stroke piston 92 by means of an o-ring seal 88 (FIG. 6) located within an annular groove 85. The lower end of the piston housing 14 is sealed against an internal surface of the lower housing 15 by means of an o-ring seal 87 located in an annular groove 86 (FIG. 6).

Figure 15:
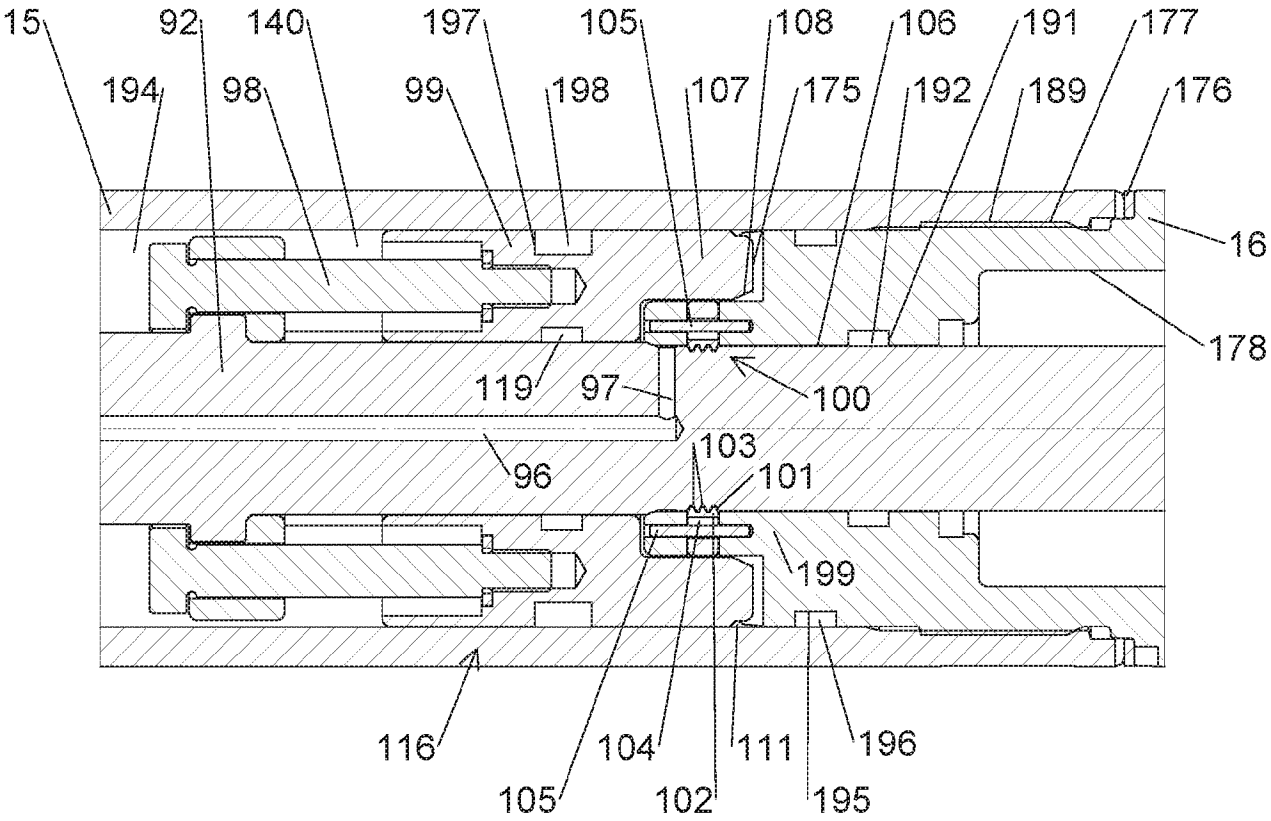
FIG. 15 is a detailed sectional view of a mechanical interlock of the tool of FIG. 1.

The stroke piston 92 has an internal bore 96 for carrying hydraulic fluid. The bore 96 is sealed and stopped at an upper end with a plug 115. The stroke piston 92 has a radially extending bore 95 perpendicular and fluidly connected to the central bore 96. An end of the radial bore 95 is exposed to hydraulic fluid between the piston seal 94 and the inner seal 88 when the stroke piston 92 is in the position shown in FIG. 6 such that the bore 95 is in fluid communication with the radial bore 89, which also has an outlet between o-ring seals 94, 88. At an opposing end, the bore 96 within the stroke piston 92 is in fluid communication with a radially extending bore 97. The radial bore 97 exposes a lower face 175 of the actuator piston 99 to hydraulic fluid. An outer surface of the actuator piston 99 has an annular groove 197 formed therein. The groove 197 accommodates a slidable annular seal 198. The actuator piston 99 is connected to the stroke piston 92 by bolts 98 to form a piston assembly 116. The piston assembly 116 is movable within the third annular chamber 194 and the gas spring piston chamber 91. The actuator piston 99 is axially slidable along the bolts 98 relative to the stroke piston 92. A spring 140 (FIG. 15) biases the actuator piston 99 to the full extent of travel. Hydraulic pressure applied to the right hand side of the annular seals 198, 119 of the actuator piston 99 can act on the end face 175 to overcome the spring 140 force to slide the actuator piston 99 along the bolts 98 (in the direction left to right as shown in FIG. 15) with the pressurised hydraulic fluid creating a chamber 111 (see the chamber 111 increasing in volume from close to zero in FIG. 15 to that shown in FIG. 17 to that shown in FIG. 18).

A lower extremity of the stroke piston 92 is provided with threads 117 (FIG. 6) that engage internal threads 118 of the end connector 193. The end connector 193 is rotationally locked by pins 179 that fix the end connector 193 to the stroke piston 92. A lower external surface of the end connector 193 has threads 190 for mating with the threads of apparatus to be deployed and set downhole.

At a lower end, the lower housing 15 has a lower threaded box connector 189 for engagement with an upper threaded box connector 177 of the connector sub 16.

The antirotation ring 176 similar to that shown in FIG. 21 is located between the lower housing 15 and the connector sub 16. An annular groove 195 (FIG. 15) is provided on an external surface of the sub 16 and an annular groove 191 is located on an internal surface of the sub 16 towards an upper end. The outer and inner annular grooves 195, 191 accommodate outer and inner o-rings 196, 192 respectively. The connector sub 16 is a substantially cylindrical steel component with a wide longitudinal bore 178 formed in a lower end of the sub 16. The connector sub 16 has an annular protrusion that accommodates an interlock mechanism 100.

A detailed view of the interlock 100 is shown in FIG. 15. The interlock mechanism 100 comprises a set of four circumferentially spaced dogs 102, each dog 102 having three angled teeth 103 on an inner surface. A matching tooth profile 101 is machined on an outer surface of the stroke piston 92 such that the teeth 103 of each dog 102 are accommodated within the profile 101 formed on the stroke piston 92. Each dog 102 has a central hole 104 into which a pin 105 is inserted to secure the dogs 102 to the connector sub 106. The actuator piston 99 has an annular nose 107 that urges the dogs 102 into the matching tooth profile 101. In this way the dogs 102 lock the connector sub 16 with the stroke piston 92, until the annular nose 107 of the actuator piston 99 is axially displaced.

Figure 25:
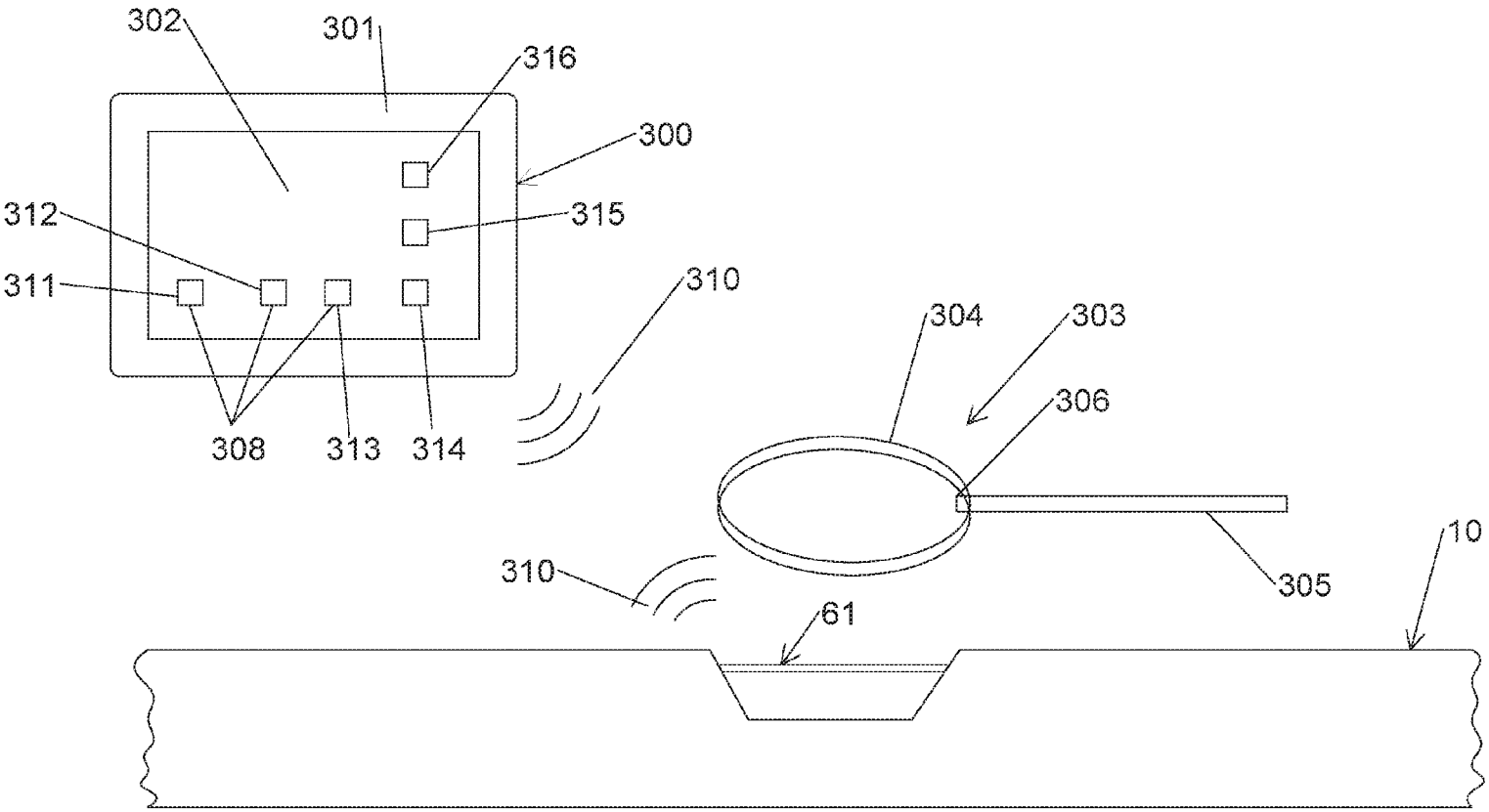
FIG. 25 is a schematic view of a magnetic initiation key and a tablet communicating with the setting tool of FIG. 1.

The transmitter (not shown) carried on the PCB 64 of the setting tool 10 is any suitable wireless transmission and receiving means such as a transceiver designed for Bluetooth™ communication and can be used with a portable and/or a handheld device such as a tablet computer 300 (FIG. 25). According to the present embodiment, the tablet computer 300 used for communication with the tool is a Panasonic Android tablet specially designed for extra durability with shock and water resistance. The tablet 300 has a protective casing 301 and a visual display screen 302. The tablet 300 has a series of applications 308 (or "apps") preinstalled that appear on the visual display screen 302 when the tablet 300 is turned on. Each application 308 is directed to a specific task.

Examples of applications include an initiation app 311 (covering the method for priming the tool 10), a post-run app 312 (covering retrieval of data from the tool 10), change out of electronics power unit app 313 (covering steps for removal and replacement of an EPU 31), a reset app 314 (covering the steps for resetting the tool 10 for re-use), a troubleshooting app 315, a programming app 316 (taking a user through options for programming the tool prior to use) and a test app 317 (indicating a performance of a test that can be run to check the correct functioning of the tool 10 prior to downhole use).

The applications all include simple animations so that use of the tablet 300 is facilitated and language is not a barrier to use.

A handheld magnetic key 303 shown in FIG. 25 is required for initiation of the tool 100. The magnetic key 303 has a handle 305 that a user can grasp and a circular head 304 which should be placed parallel to and adjacent the viewing window 61 of the tool 10 in use. The circular head 304 contains an electronic circuit, a timer, a switch and a thick walled ring magnet (approximately 1 inch or 2.54 cm in diameter). A button 306 is located proximate the handle 305.

Prior to use in a wellbore the setting tool 10 is assembled and supplied as shown in FIGS. 1 and 2. The setting tool 10 is supplied with the magnetic key 303 for initiation and the tablet 300 containing all operating instructions.

The tool 10 is designed for initiation with the key 303 to prevent the Bluetooth™ transmitter on the PCB 64 from constantly monitoring and processing Bluetooth™ signals, which would drain the batteries 30 as the tool 10 is transported to a wellbore of interest on land or offshore. Before use, it is necessary to prime the tool 10 or turn on the tool 10 by activating the magnetic sensor 164 carried on the PCB 64, which is responsive to synchronised magnetic pulses provided by the magnetic key 303. The button 306 on the magnetic key 303 is pressed to turn on a switch within the key head 304. Pressing the button 306 causes intermittent magnetisation of the ring magnet within the key head 304 in a particular pre-programmed sequence. The magnetic sensor 164 and electronics in the PCB 64 are pre-programmed to respond to the unique pre-programmed sequence emitted by the ring magnet within the key 303. Recognition of this pre-programmed sequence by the electronics in the PCB 64 'switches on' or primes the tool 10. Use of a specific sequence reduces the likelihood of accidental priming of the tool by spurious magnetisation during transportation or on a wellsite where the tool 10 is likely to be surrounded by large metal tubulars, some of which may have been subject to downhole rotation and are inadvertently magnetised.

If successful, the priming of the tool 10 electronics is denoted by the blue LED 63, emitting light that is visible through the viewing window 61. Thus, blue light emitted by the blue LED 63 signifies that the tool is switched on and the Bluetooth™ is responsive to commands from the tablet 300.

If the electronics within the tool recognise a problem, the red LED 62 emits a red light visible through the viewing window 61. Thus, red light emitted by the red LED 62 indicates a fault and a user may be instructed to contact the supplier of the setting tool 10 in these circumstances.

Figure 24:
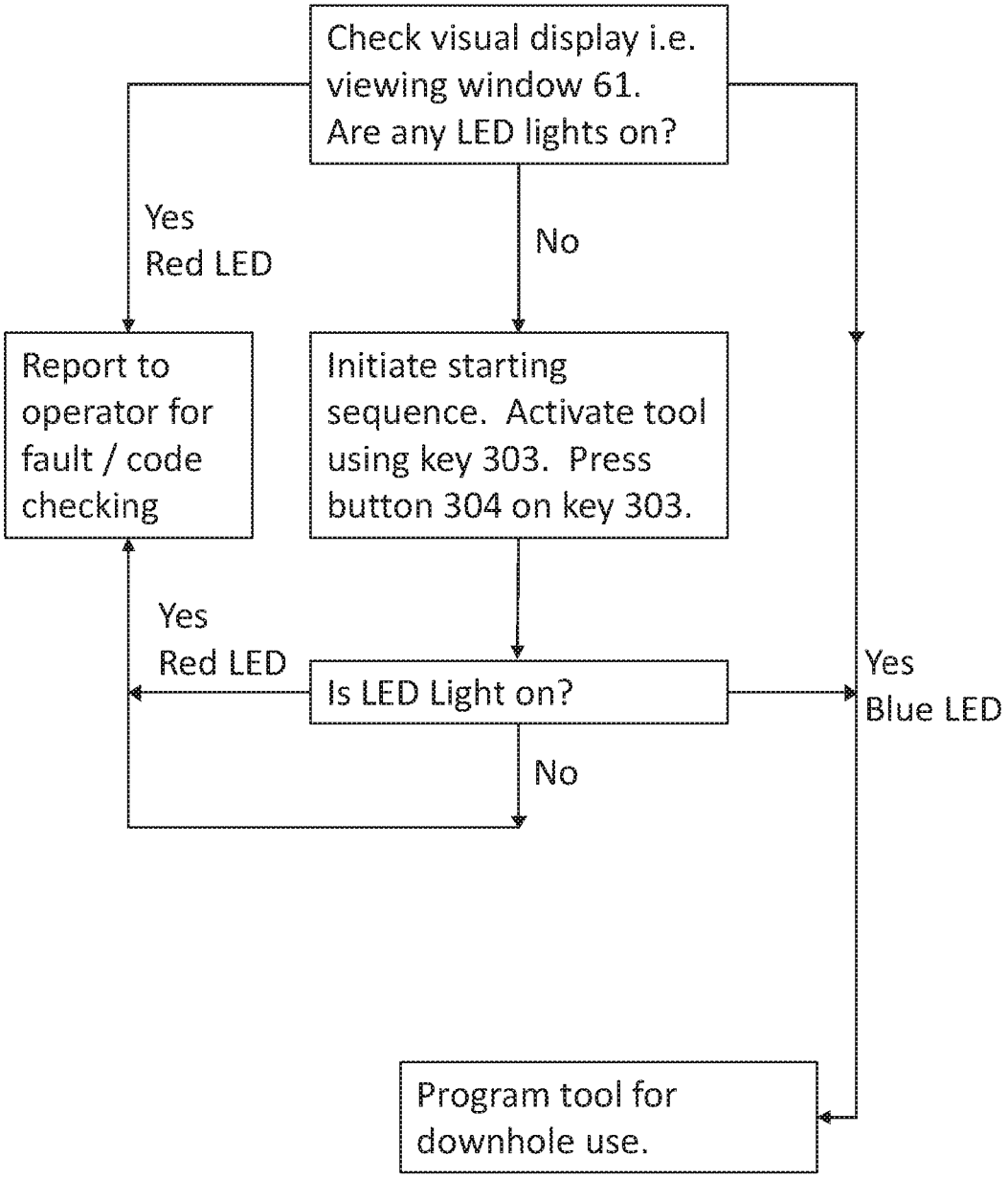
FIG. 24 is a flow diagram of a method of initiating the setting tool of FIG. 1.

An unskilled technician at the wellsite is able to follow simple instructions provided on the display screen 302 of the handheld tablet 300 in order to prime the tool. One possible sequence of instructions and outcomes is shown in FIG. 24. Thus the setting tool 10 can be switched on in a simple manner by an unskilled technician. Further the LEDs 62, 63 provide immediate visual feedback regarding the state of the setting tool 10.

The setting tool 10 is pre-programmed before use downhole according to the specific requirements of an operator. For example, an operator may want to set a timer (which may be the timer in the electronics pack 32) to initiate actuation of the motor 76 and thereby travel of the setting tool 10 after a predetermined period of time has elapsed. Additionally/alternatively, the operator may want to alter the time set such that actuation of the motor 76 occurs in indirect response to physical manipulation of the setting tool 10 by jarring slickline (not shown) attached to the top sub 20. For example, the operator may want to alter the time set in the timer within the tool 10 such that physical manipulation of the string or wireline or slickline (not shown) attached to the top sub 20 alters the timer to either advance the timer, slow down or retard the timer or actuate the timer to start counting down to operation or switch the timer off. In any event, such motion can be detected by accelerometers and motion sensors within the electronics pack 32. The operator may also require the setting force to be limited to avoid damage to the setting tool 10, the apparatus to be deployed or the wellbore itself. For example, if an operator calculates that the setting pressure required to set the apparatus is in the region of 10000-12000 psi, the operator can limit the motor 76 current to an equivalent pressure of 12500 psi (as measured by the pressure transducer 75). This maximum pressure output is large enough to ensure the apparatus is set with sufficient force but minimises the chance of damage to the tool 10, apparatus or wellbore. The value for this maximum pressure, 12500 psi can be entered into the tablet 300 via a keypad on the visual display screen 302. The tablet 300 then communicates this information to the transmitter within the tool 10 at surface to pre-program the maximum output force of the motor 76. One or more alarms can be entered into the tablet 300 so that a timer within the tablet 300 synchronises with the timer in the electronics pack 32.

Thus, an alarm can be used to alert the user to imminent actuation of the setting mechanism for example. In this manner the tablet 300 maintains an indirect link with the setting tool 10 even after the setting tool 10 is deployed downhole and the active Bluetooth™ link is no longer available. Other parameters and options can be preprogrammed so that the electronics log or respond to downhole conditions in a manner desirable to the operator. An unskilled user can enter the various commands and parameters for the operation into the tablet 300 via the visual display screen 302 and the setting tool is programmed using short wavelength Bluetooth™ transmissions 310 (illustrated schematically in FIG. 25).

Figure 23:
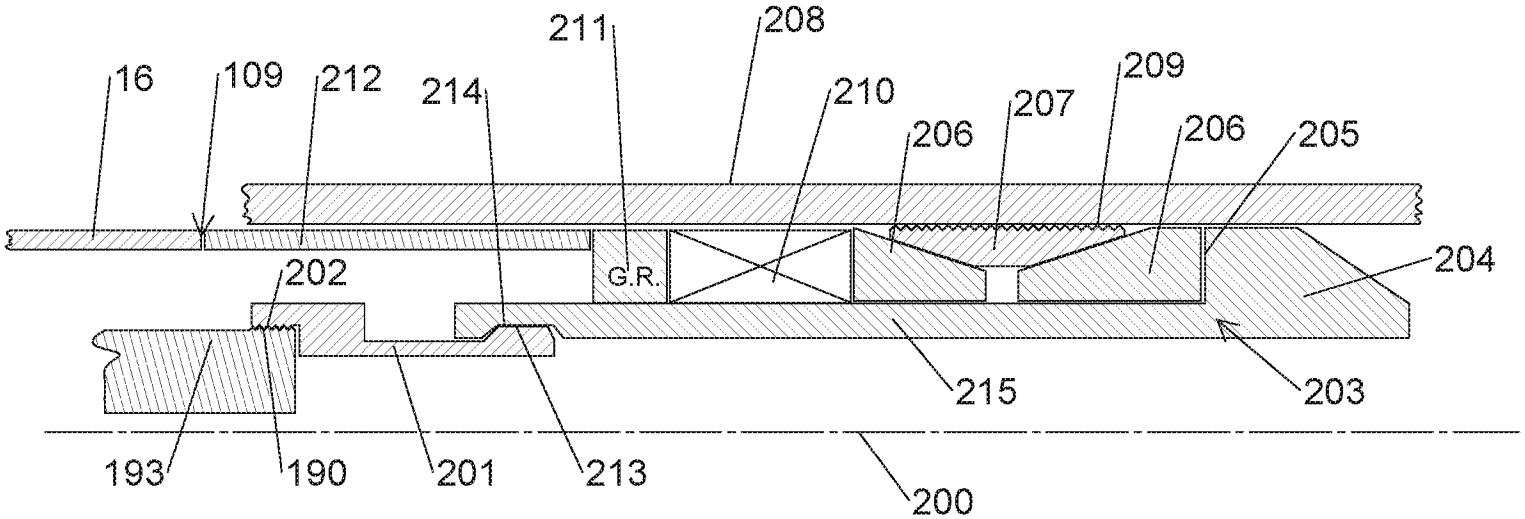
FIG. 23 is a schematic view of a lower part of the tool of FIG. 1 engaged with a plug to be set.

According to the present embodiment the setting tool 10 is intended to deploy a packer 203 (FIG. 23) downhole in a wellbore. The packer 203 is releasably attached to the end connector 193 of the setting tool 10. Threads 190 on the end connector 193 mate with threads 202 on an upper end of an engager 201. A lower end of the engager 201 has a latch 213 that engages a groove 214 on an upper internal end of a body 215 of the packer 203. A lower 18 end portion 204 of the packer 203 body 215 has an increased diameter portion thereby defining an upwardly facing annular step 205. A pair of opposing annular ramps 206 having inclined outer surfaces are coupled to an outer surface of the packer 203. The lower ramp 206 is located adjacent the annular step 205. Three sets of slips 207 are radially spaced and positioned between the ramps 206 with complementary inclined inner surfaces. The slips 207 have a profiled external surface 209 for gripping the wellbore. A rubber packing element 210 is positioned between an upper end of the upper ramp 206 and a gauge ring 211. A housing 212 extends from an upper end of the packer 203 and an end face 109 of the connector sub 16 of the setting tool 10 shoulders out on an upper end face of the housing 212.

Figure 16:
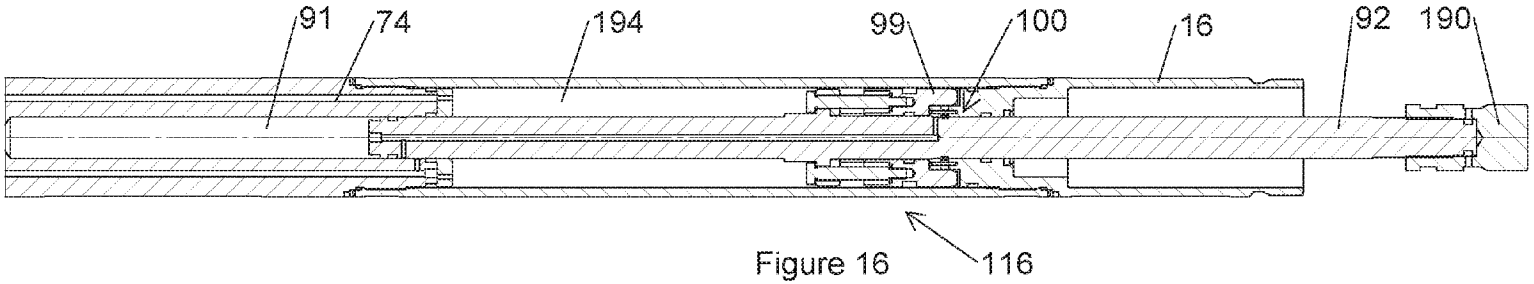
FIG. 16 is a sectional view of part of the tool of FIG. 1 in a run-in configuration.

The setting tool 10 is run downhole in a run-in configuration shown in FIG. 16. The setting tool is run downhole on slickline connected to threads 23 on the top sub 20 and with the attached packer 203 at the lower end 19. The pressure transducer 75 registers a gradual rise in pressure as the tool 10 is run downhole. The interlock mechanism 100 prevents the tool 10 from premature setting by locking the stroke piston 92 to the connector sub 16. The packer 203 and attached setting tool 10 are run downhole to the required depth. Shortly prior to deployment of the packer 203, the tablet 300 at surface sounds an alarm to alert an operator that actuation of the setting tool 10 and deployment of the packer 203 is imminent. In the event that the operator was not located in the correct position or should any unforeseen delays have been experienced, the operator could override the setting sequence by manipulating the slickline in such a manner that the resulting movement is registered by accelerometers and motion sensors. This physical manipulation of the tool can trigger a pre-programmed event within the electronics pack 32 such as a resetting of the timer.

Figure 17:
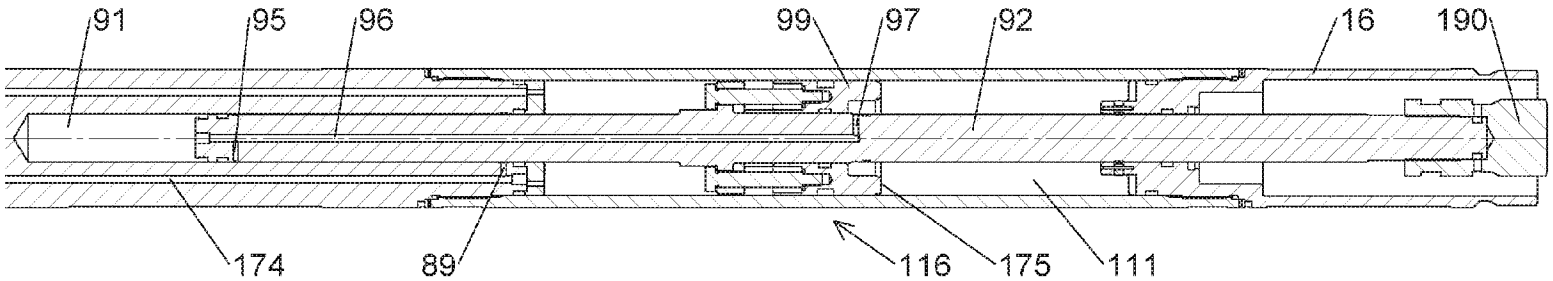
FIG. 17 is a sectional view of part of the tool of FIG. 16 in a partially set configuration.

According to the present embodiment, the setting tool 10 is actuated by the timer in the electronics pack 32. Once the tool 10 is actuated, the electronics pack 32 initiates the motor 76 to provide an output force that is stepped up by the gearbox 77 to drive the pump 78. The pump 78 draws clean hydraulic fluid from the second chamber 73 through the inlet 80, which fluid is pumped through the outlet 81 and travels via bores 82, 83, 174, 89, 95, 96, 97 to act on the end face 175 of the actuator piston 99 between the seals 119, 198. Since the interlock mechanism 100 locks the connector sub 16 to the stroke piston 92, the stroke piston 92 is constrained against collective movement with the actuator piston 99 to permit some pressure in the hydraulic fluid to be built up to enable diagnostic checks to be made. Once made, continued application of hydraulic fluid pressure on the end face 175 of the actuator piston 99 overcomes the bias of the spring 140 to compress the spring 140 and to urge the actuator piston 99 axially uphole so that the piston 99 and the bolts 98 slide along the piston 92 (from right to left in FIG. 6). When the annular nose 107 of the actuator piston 99 has travelled a short distance in the uphole axial direction, an inclined surface 108 is adjacent the dogs 102 of the locking mechanism 100. The dogs 102 are now able to move radially outwardly urged by the geometry of the teeth 103, and the serrated profile 101. The 600 inclined profile 101 aids the radial movement of the teeth 103 as the teeth 103 'climb out' and thereby release the interlock mechanism 100. Thus the interlock mechanism 100 is disengaged and the stroke piston 92 is no longer locked to the connector sub 16. The actuator piston 99 and the stroke piston 92 are able to move collectively as the piston assembly 116 as shown in FIG. 17.

Hydraulic fluid supplied by the pump 78 continues to act on the lower face 175 of the actuator piston 99. As a result, the piston assembly 116 moves axially relative to and away from the connector sub 16 in the upwards direction (from right to left in FIG. 17). Axial movement of the piston assembly 116 causes the stroke piston 92 to compress gas within the chamber 91 of the gas spring 90. The non return valve in the pump 78 ensures that the piston assembly 116 remains locked in its axial position. Current supplied to the motor 76 is monitored. The electronics pack 32 ensures that the motor 76 does not provide an output during the setting process that equates to a setting pressure of more than 12500 psi.

Figure 18:
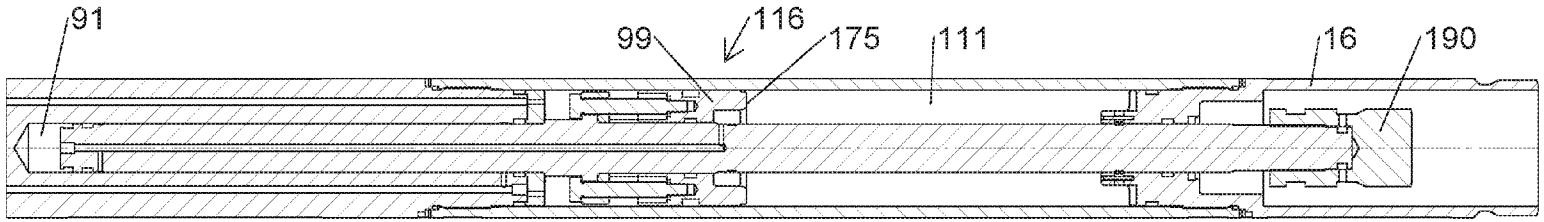
FIG. 18 is a sectional view of part of the tool of FIG. 16 in a set configuration.

Axial movement of the piston assembly 116 causes a downhole pushing force on the packer 203 by the end face 109 of the connector sub 16 acting against the housing 212 of the packer 203. In other words, end face 109 remains stationary and provides an anchor or reaction point against which the force provided by the axial upwards movement of the piston assembly 116 can react against to set the packer 203 or plug (not shown) or any other suitable tool to be set. Axial movement of the piston assembly 116 also provides a pulling force on the packer 203 as the stroke piston 92 moves uphole and this movement is translated to the packer 203 via the connector 201. As a result the ramps 206 and the rubber packing element 210 are squeezed between the gauge ring 211 and the annular step 205. As the ramps 206 converge the slips 207 are driven radially outwardly until the teeth 209 engage the wellbore. The rubber packing element 210 is deformable and squeezed to make a contact seal with the wellbore. According to the present embodiment the force required to set the packer 203 is provided by the hydraulic fluid located within chamber 111 reaching 12000 psi. Once this pressure is reached the slips 207 and the rubber packing element 210 are in full contact with the wellbore. A shear ring (for example within the connector 201) within the packer 203 apparatus shears to release the setting tool 10 from the packer 203 so that the setting tool 10 can be pulled out of the hole back to surface. FIG. 18 shows the final position of the setting tool 10 in the set configuration following deployment of the packer 203. The pressure transducer 75 and electronics pack 32 register that the pressure has reached 12000 psi. In addition, motion sensors within the PCBs log the jolt received by the tool 10 as the packer 203 is deployed and release of the setting tool 10 occurs. The pressure transducer 75 senses the consequent drop in pressure in chamber 111, which is fed back to the electronics pack 32. Thus the electronics pack 32 logs the combination of data detected within a short time window and equates this information to the deployment of the packer 203. This information is then fed back to the operator by Bluetooth™ once the tool 10 is retrieved to surface, providing confirmation of successful deployment of the packer 203.

Once the packer 203 has been deployed, and the setting tool 10 is released, it can be pulled out of the hole on the slickline. An operator can then access electronic data logged during the tool 10 run. The tablet 300 is located within communication range of the viewing window 61 and data from the setting tool 10 is downloaded via the Bluetooth™ link with the help of the post-run app 312 (covering retrieval of data from the tool 10).

A run report can be downloaded onto the tablet 300 from the tool 10 giving details such as a force displacement graph. This provides an operator with assurance that the packer 203 has been correctly deployed and also allows an operator to assess correct function of the setting tool 10. Data such as a temperature profile, displacement measurements, pump efficiency and other stored information can be downloaded from the electronics pack 32 to inform the operator and provide an indication of the success of the run, health of the tool 10 and downhole conditions.

Should the Bluetooth™ communication link with the tool 10 fail, a redundancy is provided which still allows data to be derived from the electronics pack 32. A redundancy communications pack (not shown) having identical pins 42 to the connector 40 can be stabbed directly in the socket 35 of the EPU 31. Thus data from the electronics pack 32 can also be derived via a hard link with the redundancy communications pack.

As well as downloading data from the electronics pack 32 the redundancy communications pack can override and reprogram the electronics.

If an operator wants the setting tool 10 to deploy another apparatus downhole, the tool 10 needs to be reset for reuse. After use the tool 10 is in the set configuration shown in FIG. 18 and needs to return to the run-in configuration shown in FIG. 16. The operator would refer to the reset app 314 for animations instructing the steps required for reset. A suitable key such as an allen key is inserted into the hexagonal socket 184 of the plug 84. The allen key is turned several times to rotate the plug 84 towards the port 182. The frustoconical surface 185 of the plug moves radially to unplug the radial bore 83. Thus clean hydraulic fluid travels from the radial bore 83 along the fluid bypass slot 187 of the plug 84 (FIG. 22) and communicates with the return bore 74. The hydraulic fluid is therefore returned along the fluid path from chamber 111 through radial bore 97, through central bore 96, through radially extending bore 95 (and thereby travelling through the stroke piston 92) (FIG. 6) and through radial bore 89 and along longitudinally extending bore 174 (FIG. 5) and along radial bore 83 past the plug 84 via the fluid bypass slot 187 and along longitudinal bore 74 and into third fluid chamber 194 (see FIGS. 6 and 16), urged by the gas spring piston 90. The compressed gas within the chamber 91 is free to expand and push the stroke piston 92 towards a lower end 19 of the tool 10. Movement of the stroke piston 92 pushes fluid out of the chamber 111 and allows return of this fluid to the third annular chamber 194 which is therefore now also in fluid communication with the second annular chamber 73. Thus the tool 10 is easily reset without any mechanical manipulation.

A supplier may recommend that a technician performs a minor servicing of the tool after a certain number of runs, such as ten trips downhole. The tablet 300 provides the operator with an automatic alert when a minor service interval is reached. During the minor service, the batteries 30 and the electronics pack 32 are replaced. The operator refers to the 'change out of electronics power unit app' 313 for animations giving clear instructions regarding replacement of the EPU 31.

The first step is to remove the EPU 31 from the upper housing 12. The tabs 122 on the anti-rotation ring 121 are deformed such that the top sub 20 is separable from the upper housing 12. The operator holds the end 23 of the top sub 20 and applies an axial pulling force. Since the top sub 20 is connected to the EPU 31 by the horseshoe connector 25 engaging with the end connector 137, the EPU 31 also moves axially out of the upper housing 12. The horseshoe connector 25 and detent mechanism 138 allows a controlled removal of the EPU 31. The lithium batteries 30 within the EPU 31 are contained within the unit housing 131 and released in a controlled manner, which is an important safety feature for personnel in the region of potentially dangerous lithium batteries 30. The used EPU 31 can now be disposed of, recycled or returned to the supplier.

A replacement EPU 31 is now ready to be inserted within the tool 10 upper housing 12. The replacement EPU 31 is identical to the previous EPU 31. The top sub 20 is provided with an anti rotation ring 121 (FIG. 3) abutting the annular shoulder 120 (FIG. 7). The end connector 137 (FIG. 8) of the replacement EPU 31 is inserted into the c-shaped groove 27 of the horseshoe connector 25 (FIG. 7) of the top sub 20. The top sub 20 is then rotated until a technician senses that the spring loaded detent mechanism 138 (FIG. 8) clicks into detent hole 124 (FIG. 7) to releasably connect the end connector 137 and the electronics power unit 31. The top sub 20 and replacement EPU 31 are then offered up to the uppermost end (i.e. left hand end as viewed in FIG. 2) of the upper housing 12. The lower end (i.e. the right hand end as viewed in FIG. 2) of the EPU 31 is then inserted into the upper end of the upper housing 12. The alignment notch 125 (FIG. 7) provided on the top sub 20 is aligned by the operator with the viewing window 61 of the tool 10. This visual aid allows approximate alignment of the key 33 (FIG. 4) on the end cap 34 of the EPU 31 with the keyway 44 (FIG. 11) in the EM subassembly 50. The operator applies an axial force to the top sub 20 to urge the EPU 31 into the upper housing 12. The operator pushes the EPU 31 into the upper housing 12 until the orientation washer 36 aligns with the locator pin 41 guided by the key 33 sliding within the keyway 44 of the EM subassembly 50. The combined length of the connected top sub 20 and EPU 31 is arranged during the engineering design process with reference to the length of the upper housing 12 such that, at this point in the tool 10 make up sequence, the pin threads 28 of the top sub 20 meet the upper box threaded connector 17 of the upper housing 12 at which point the operator must rotate the top sub 20 (and in doing so overcomes the spring of the spring loaded detent mechanism 138) such that the top sub 20 rotates relative to the EPU 31 and by virtue of the cooperation of the threads 28 and 17, continued rotation of the top sub 20 relative to the housing 12 axially advances both the top sub 20 and the EPU 31 into the housing 12 and further continued axial movement of the top sub 20 and attached EPU 31 connects the socket 35 with the fifteen upper electrical pins 42. Tabs 122 of the anti-rotation ring 121 are deformed into position to rotationally lock the top sub 20 and the upper housing 12. The minor service interval is now complete.

The tool can be reset, reprogrammed and re-run as described multiple times. Thus, the tool is quickly ad simply reset for reuse without the involvement of a skilled technician.

The supplier of the tool 10 receiving a used EPU 32 can access the electronics pack 32 and download data via the socket 35. Stored data from the pressure transducer 75, accelerometer, temperature sensor, vibration sensor and motion sensor allow the supplier to compile a run history of the tool 10. This field run history can be advantageous to the supplier to derive information relevant to the warranty for the tool 10 or the time intervals between major service intervals for the tool 10.

The operator of the tool 10 can be alerted to major service intervals, which may be required after, say fifty runs. Major service intervals can involve replacement of the EM subassembly 50. The major service interval can also include a change of hydraulic fluid.

The batteries 30 are consumable and require regular replacement to power the tool 10 downhole. Additionally the stacked PCBs 139 within the electronics pack 32 are subject to excessive shock and vibration in the downhole environment, the damaging effects of which are shown to be cumulative. Electronics components are also prone to failure by fatigue due to thermal cycling. Thus, the electronics on the PCBs 139 have a limited life. Grouping and inclusion of these two consumable components (the batteries 30 and electronics pack 32) within the EPU 31 provide a discrete self-contained subassembly suitable for removal and replacement with a new EPU 31 subassembly. The EPU 31 is designed for ease of access, removal and insertion. This has the advantage that there is no requirement for a skilled technician. Any operator following a simple list of instructions provided by the 'change out of electronics power unit app' 313 on the tablet 300 has the ability to remove and replace the EPU 31. Additionally the EPU 31 and EM subassembly 50 can be vibration and temperature tested and proven to ensure that the components are robust and able to operate within the rated limits before dispatch to an operator for use.

The gas spring 90 within the tool 10 has several advantages. The compressed gas within the chamber 91 of the gas spring 90 provides an automatic 're-cock' on release of the plug 84. No manual intervention is required, other than the act of plug 84 release using several turns of a standard allen key. The automatic 're-cock' allows the tool 10 to be set for reuse without using any power from the batteries 30, which would cause additional power drain from the tool 10. There is no requirement for the tool 10 to be stripped down for the 're-cock' and therefore the internal mechanism remains isolated resulting in minimal or no debris ingress into the tool 10 that may impair proper functioning. The presence of the gas spring 90 downhole is also an advantage. Since the gas within the chamber 91 is sealed at ambient surface pressure, a pressure differential exists between the gas within the chamber 91 and the greater ambient pressure downhole at depth in a wellbore. Thus, on release of the interlock mechanism 100, the compressible gas within the chamber 90 assists with the setting of the tool 10.

An operator of the tool 10 can ensure that downhole use of the tool 10 conforms with the tested and verified safe operating limits of the tool 10. For example, the tool 10 will be rated for use in an environment with a maximum temperature, such as 1500 C. On retrieval of the tool 10, the operator can verify that the tool 10 has been exposed to temperatures lower than the maximum temperature rating. Temperature data is logged by the temperature sensor (not shown) embedded within and electronically linked with the electronics pack 32. Temperature data is downloaded from the electronics pack 32 via the Bluetooth™ Link with the handheld tablet. The handheld tablet provides the figures of downhole temperatures on the digital display. Should the electronics pack 32 fail to record temperature values or some problem is encountered downloading temperature data, the temperature sensitive labels (not shown) fixed to the batteries 30 provide a secondary indication of maximum temperature reached downhole. This data provides assurance for the operator that the tool 10 is working within safe rated operating limits. Should the tool 10 have been exposed to higher temperatures than those for which it is rated, the tool 10 can be returned to the manufacturer for safety checks and for the verification and/or replacement of temperature sensitive components within the tool 10.

The described setting tool 10 has many advantages. Set-up, use and reset of the tool 10 is simple and quick. These activities can be performed with the aid of the tablet 300 and without the need for a skilled technician. Consumable components within the tool 10 can be easily removed and replaced. The tool 10 is 'smart' and versatile since the electronics within the tool 10 allow reprogramming to account for different downhole conditions and apparatus to be deployed. Electronics within the tool 10 provide feedback, such as data on downhole conditions and performance data of the tool 10. The viewing window 61 provides a visual indicator of the state of the tool 10 and immediately alerts an operator to a potential problem by emitting light from the red LED 62 or no LED 62, 63 response when expected. The overall design of the tool 10 allows multiple use of the tool 10 with minimal intervention.

This description is intended for the purposes of illustration only. Modifications and alterations can be made without departing from the scope of the invention.

The detailed description of the invention sets forth numerous specific details in order to provide a thorough understanding of the invention. However it will be apparent to a person skilled in the art that the invention may be practised without some or all of these specific details.

Although the described embodiment deploys the setting tool 10 on slickline, the setting tool 10 could also be run downhole on wireline, braided line or any other type of downhole deployment means with the connector to the deployment means provided at the upper end 23 of the top sub 20 being altered appropriately.

Any relatively portable tablet, computer, phone or other electronic device that can communicate with the tool electronics can be used in combination with the setting tool. Suitable tables or portable devices include, but are not limited to, Apple i-pad., any Android tablet, any Microsoft table, any mobile phone. The described embodiment refers to communication between the portable and/or handheld device and the setting tool 10 using Bluetooth™, although other methods of remote or wireless communication can be utilised such as WiFi or radio frequency identification (RFID). Additionally, different coloured LED's or other indicators could be used.

The setting tool 10 can be used to deploy apparatus in any type of wellbore such as in cased hole or open hole.

The invention claimed is:

1. A setting tool for use in a downhole wellbore, the setting tool comprising:

a hydraulic fluid pumping mechanism for providing pressurised hydraulic fluid;

a piston mechanism moveable by said pressurised hydraulic fluid acting upon a portion of the piston mechanism;

and a resetting mechanism which when operated releases the pressurised hydraulic fluid from acting upon said portion of the piston and which results in the resetting of the setting tool; and wherein the setting tool further comprises a biasing device adapted to store energy when said piston mechanism moves in a first direction until the resetting mechanism is operated following which the biasing device releases said energy and in so doing moves said piston mechanism in a second direction to return said piston mechanism to a starting position thereby resetting said setting tool.

2. A setting tool according to claim 1, wherein the setting tool is operable to provide mechanical movement to set a downhole apparatus when required and wherein movement of the piston mechanism provides the mechanical movement to set the said downhole apparatus when required and wherein the piston mechanism is located within a cylinder arrangement and which is further located within a housing of the setting tool.

3. A setting tool according to claim 2, wherein movement of the piston mechanism in a first direction provides the mechanical movement to set the said downhole apparatus when required and movement of the piston mechanism in a second direction results in the resetting of the setting tool when required.

4. A setting tool according to claim 3, wherein the piston mechanism is moved in the first direction by hydraulic fluid being pumped from a first chamber in fluid contact with a first side or face of the piston mechanism to a second chamber in fluid contact with a second side or face of the piston mechanism.

5. A setting tool according to claim 4, wherein the piston mechanism is moved in the second direction by hydraulic fluid being moved from the second chamber to the first chamber.

6. A setting tool according to claim 5, wherein the hydraulic fluid is moved to the second chamber from the first chamber by the hydraulic fluid pump which results in movement of the piston mechanism in the first direction.

7. A setting tool according to claim 4, wherein upon actuation of the resetting mechanism, the biasing device releases the said stored energy which causes the piston mechanism to move in the second direction and which causes the hydraulic fluid to move from the second chamber to the first chamber.

8. A setting tool according to claim 4, wherein the resetting mechanism comprises a pressure release mechanism and which permits hydraulic fluid to flow from the second chamber back to the first chamber in order to reset the tool for a future setting operation.

9. A setting tool according to claim 4, wherein unless and until the resetting mechanism is actuated, pressurised hydraulic fluid is permitted to flow from the first chamber to the second chamber but is prevented from flowing back from the second chamber to the first chamber.

10. A setting tool according to claim 4, wherein the resetting mechanism comprises an obturation member and which may be moved by an operator between:

a first (setting) configuration in which hydraulic fluid is permitted to flow from the first chamber to the second chamber and is prevented from flowing from the second chamber to the first chamber; and a second (re-set) configuration in which hydraulic fluid is permitted to flow from the second chamber back to the first chamber.

11. A setting tool according to claim 10, wherein the obturation member is located in an aperture formed in a housing of the setting tool and is adapted to be moveable:— into a sealed relationship with a hydraulic fluid conduit such that no fluid may pass along the said hydraulic fluid conduit when the operator requires the first (setting configuration); and out of a sealed relationship with the said hydraulic fluid conduit such that fluid may pass along the said hydraulic fluid conduit when the operator requires the second (re-set) configuration.

12. A setting tool according to claim 10, wherein the obturation member and the aperture are provided with corresponding and co-operating engagement means such that the obturation member is adapted to be moveable in the aperture by means of rotating it with a suitable tool.

13. A setting tool according to claim 4 wherein the setting tool comprises a locking mechanism which resists movement of the piston mechanism in the first direction until at least a pre-determined pressure is reached in the pressurised hydraulic fluid in the second chamber.

14. A setting tool according to claim 13, wherein the locking mechanism permits movement of the piston mechanism in the first direction once at least a pre-determined pressure is reached in the pressurised hydraulic fluid in the second chamber.

15. A setting tool according to claim 1, wherein the setting tool comprises a locking mechanism which resists movement of the piston mechanism in at least one of first and second directions.

16. A setting tool according to claim 15 wherein the locking mechanism comprises a locking piston arrangement which is biased in a first direction into a locked configuration by a locking biasing device.

17. A setting tool according to claim 16 wherein movement of the locking piston arrangement in the second direction against the biasing device overcomes the biasing action of the biasing device and results in an unlocked configuration of the locking mechanism.

18. A setting tool according to claim 17 wherein the locking mechanism further comprises a locking member which is selectively engageable with the said piston mechanism and the locking piston arrangement is further adapted such that:— when the locking piston arrangement is in the locked configuration, it prevents the locking member from disengaging with the said piston mechanism; and when the locking piston arrangement is in the unlocked configuration, it permits the locking member to disengage from the said piston mechanism.

19. A setting tool according to claim 18, wherein the locking member disengages from the said piston mechanism by relative movement between the two in a radial direction with respect to the longitudinal axis of the setting tool which then permits longitudinal movement of the said piston mechanism with respect to the locking member and other parts of the setting tool.

20. A setting tool according to claim 16, wherein the locking member comprises one of more dog members engageable with one or recesses formed on the piston mechanism.

21. A setting tool according to claim 1, wherein the setting tool is a downhole setting tool for setting an apparatus downhole and which is adapted to be run into a downhole wellbore to set the apparatus downhole and which is further adapted to be pulled from the downhole wellbore and re-set for a subsequent operation.

22. A setting tool according to claim 1, further comprising a visual indication unit adapted to display variable data or other variable information to an operator of the tool.

23. A setting tool according to claim 22, wherein the visual indication unit is mounted on an outer part or outer housing of the setting tool, and wherein the visual indication unit is outwardly facing such that it is viewable by an operator without having to open the setting tool or otherwise interfere with the setting tool.

24. A setting tool according to claim 1, wherein the setting tool further comprises a housing and further comprises a power source for supply of electric power to operate the hydraulic fluid pumping mechanism.

25. A setting tool according to claim 24, wherein the setting tool further comprises electronic components connectable to the power source and at least one module for accommodating the power source and the electronic components, wherein the at least one module is connectable with the housing in a first configuration for downhole use and removable from the housing in a second configuration in which the at least one module and the housing are separable.

26. A method for resetting a setting tool including the steps of:

(i) running the setting tool downhole;

(ii) actuating the setting tool by moving a piston mechanism in a first direction and in so doing, storing energy in a biasing device and thereby deploying an apparatus downhole;

(iii) retrieving the setting tool to surface; and (iv) bleeding off pressure in the setting tool, thereby releasing the energy stored in the biasing device and in so doing moving said piston mechanism in a second direction to return said piston mechanism to a starting position, thereby resetting said setting tool.

27. A method according to claim 26, wherein the method further comprises the step of:—

(v) repeating steps (i) to (iv);

thereby providing a method for multiple use of the setting tool.

28. A method according to claim 26, wherein following step (iii), the method further includes the step of remotely accessing data from the setting tool.

29. A method according to claim 26 wherein the setting tool comprises a hydraulic fluid pumping mechanism for providing pressurised hydraulic fluid;

a piston mechanism moveable by said pressurised hydraulic fluid acting upon a portion of the piston mechanism; and a resetting mechanism which when operated releases the pressurised hydraulic fluid from acting upon said portion of the piston and which results in the resetting of the setting tool.

30. A setting tool for use in a downhole wellbore, the setting tool comprising:

a hydraulic fluid pumping mechanism for providing pressurised hydraulic fluid;

a piston mechanism moveable by said pressurised hydraulic fluid acting upon a portion of the piston mechanism;

and a resetting mechanism which when operated releases the pressurised hydraulic fluid from acting upon said portion of the piston and which results in the resetting of the setting tool;

wherein the setting tool comprises a locking mechanism which resists movement of the piston mechanism in at least one of first and second directions; and wherein the locking mechanism comprises a locking piston arrangement which is biased in a first direction into a locked configuration by a locking biasing device.

31. A setting tool for use in a downhole wellbore, the setting tool comprising:

a hydraulic fluid pumping mechanism for providing pressurised hydraulic fluid;

a piston mechanism moveable by said pressurised hydraulic fluid acting upon a portion of the piston mechanism;

and a resetting mechanism which when operated releases the pressurised hydraulic fluid from acting upon said portion of the piston and which results in the resetting of the setting tool;

further comprising a visual indication unit adapted to display variable data or other variable information to an operator of the tool;

wherein the visual indication unit is mounted on an outer part or outer housing of the setting tool, and wherein the visual indication unit is outwardly facing such that it is viewable by an operator without having to open the setting tool or otherwise interfere with the setting tool.

* * * * *